US011297903B2

(12) United States Patent
Soderberg et al.

(10) Patent No.: US 11,297,903 B2
(45) Date of Patent: Apr. 12, 2022

(54) REEL-BASED LACING SYSTEM

(71) Applicant: Boa Technology, Inc., Denver, CO (US)

(72) Inventors: Mark S. Soderberg, Conifer, CO (US); Michael J. Nickel, Golden, CO (US); Sean Cavanagh, Golden, CO (US)

(73) Assignee: Boa Technology, Inc., Denver, CO (US)

( * ) Notice: Subject to any disclaimer, the term of this patent is extended or adjusted under 35 U.S.C. 154(b) by 108 days.

(21) Appl. No.: 16/557,695

(22) Filed: Aug. 30, 2019

(65) Prior Publication Data

US 2020/0054097 A1 Feb. 20, 2020

Related U.S. Application Data

(63) Continuation of application No. 14/821,556, filed on Aug. 7, 2015, now Pat. No. 10,413,019, which is a continuation of application No. 13/273,060, filed on Oct. 13, 2011, now Pat. No. 9,101,181.

(51) Int. Cl.
*A43C 11/16* (2006.01)

(52) U.S. Cl.
CPC ..... *A43C 11/165* (2013.01); *Y10T 24/2183* (2015.01)

(58) Field of Classification Search
CPC ..... A43C 11/165; Y10T 24/2183; B65H 75/4428; B65H 75/4431; B65H 75/4481; B65H 75/4436; B65H 75/4442
See application file for complete search history.

(56) References Cited

U.S. PATENT DOCUMENTS

| | | | |
|---|---|---|---|
| 59,332 | A | 10/1866 | White et al. |
| 80,834 | A | 8/1868 | Prussia |
| 117,530 | A | 8/1871 | Foote |
| 228,946 | A | 6/1880 | Schulz |
| 230,759 | A | 8/1880 | Drummond |
| 568,056 | A | 9/1896 | Vail, Jr. |

(Continued)

FOREIGN PATENT DOCUMENTS

| | | |
|---|---|---|
| AT | 127075 | 2/1932 |
| AT | 244804 | 1/1966 |

(Continued)

OTHER PUBLICATIONS

Translation of EP 0651954 (Year: 2021).*

(Continued)

*Primary Examiner* — Sang K Kim
*Assistant Examiner* — Nathaniel L Adams
(74) *Attorney, Agent, or Firm* — Kilpatrick Townsend & Stockton, LLP

(57) ABSTRACT

A lacing system configured to selectively adjust the size of an opening on an object and allow for the incremental release of the lace within the lacing system. The lacing system can have a reel that includes a housing, a spool supported by the housing, and a knob supported by the housing. The reel can be configured so that cable is gathered in the channel formed in the spool when the spool is rotated in a first direction relative to the housing, and so that cable can be incrementally released from the spool when the spool is rotated in a second direction relative to the housing.

19 Claims, 19 Drawing Sheets

(56) References Cited

U.S. PATENT DOCUMENTS

| | | | |
|---|---|---|---|
| 746,563 | A | 12/1903 | McMahon |
| 908,704 | A | 1/1909 | Sprinkle |
| 1,060,422 | A | 4/1913 | Bowdish |
| 1,062,511 | A | 5/1913 | Short |
| 1,090,438 | A | 3/1914 | Worth et al. |
| 1,170,472 | A | 2/1916 | Barber |
| 1,288,859 | A | 12/1918 | Feller et al. |
| 1,393,188 | A | 10/1921 | Whiteman |
| 1,469,661 | A | 2/1922 | Migita |
| 1,412,486 | A | 4/1922 | Paine |
| 1,416,203 | A | 5/1922 | Hobson |
| 1,481,903 | A | 4/1923 | Hart |
| 1,530,713 | A | 2/1924 | Clark |
| 1,995,243 | A | 6/1934 | Clarke |
| 2,088,851 | A | 8/1937 | Gantenbein |
| 2,109,751 | A | 3/1938 | Matthias et al. |
| 2,124,310 | A | 9/1938 | Murr, Jr. |
| 2,316,102 | A | 4/1943 | Preston |
| 2,539,026 | A | 1/1951 | Mangold |
| 2,611,940 | A | 9/1952 | Cairns |
| 2,673,381 | A | 3/1954 | Dueker |
| 2,907,086 | A | 10/1959 | Ord |
| 2,991,523 | A | 7/1961 | Del Conte |
| 3,035,319 | A | 5/1962 | Wolff |
| 3,112,545 | A | 12/1963 | Williams |
| 3,163,900 | A | 1/1965 | Martin |
| 3,169,325 | A | 2/1965 | Fesl |
| 3,197,155 | A | 7/1965 | Chow |
| 3,221,384 | A | 12/1965 | Aufenacker |
| 3,276,090 | A | 10/1966 | Nigon |
| 3,401,437 | A | 9/1968 | Christpohersen |
| 3,430,303 | A | 3/1969 | Perrin et al. |
| 3,491,465 | A | 1/1970 | Martin |
| 3,545,106 | A | 12/1970 | Martin |
| 3,618,232 | A | 11/1971 | Shnuriwsky |
| 3,668,791 | A | 6/1972 | Salzman et al. |
| 3,678,539 | A | 7/1972 | Graup |
| 3,703,775 | A | 11/1972 | Gatti |
| 3,729,779 | A | 5/1973 | Porth |
| 3,738,027 | A | 6/1973 | Schoch |
| 3,793,749 | A | 2/1974 | Gertsch et al. |
| 3,808,644 | A | 5/1974 | Schoch |
| 3,934,346 | A | 1/1976 | Sasaki et al. |
| 3,975,838 | A | 8/1976 | Martin |
| 4,095,354 | A | 6/1978 | Annovi |
| 4,130,949 | A | 12/1978 | Seidel |
| 4,142,307 | A | 3/1979 | Martin |
| 4,227,322 | A | 10/1980 | Annovi |
| 4,261,081 | A | 4/1981 | Lott |
| 4,267,622 | A | 5/1981 | Burnett-Johnston |
| 4,408,403 | A | 10/1983 | Martin |
| 4,433,456 | A | 2/1984 | Baggio |
| 4,433,679 | A | 2/1984 | Mauldin et al. |
| 4,463,761 | A | 8/1984 | Pols et al. |
| 4,480,395 | A | 11/1984 | Schoch |
| 4,551,932 | A | 11/1985 | Schoch |
| 4,555,830 | A | 12/1985 | Petrini et al. |
| 4,574,500 | A | 3/1986 | Aldinio et al. |
| 4,616,524 | A | 10/1986 | Biodia |
| 4,619,057 | A | 10/1986 | Sartor et al. |
| 4,620,378 | A | 11/1986 | Sartor |
| 4,631,839 | A | 12/1986 | Bonetti et al. |
| 4,631,840 | A | 12/1986 | Gamm |
| 4,633,599 | A | 1/1987 | Morell et al. |
| 4,654,985 | A | 4/1987 | Chalmers |
| 4,660,300 | A | 4/1987 | Morell et al. |
| 4,660,302 | A | 4/1987 | Arieh et al. |
| 4,680,878 | A | 7/1987 | Pozzobon et al. |
| 4,719,670 | A | 1/1988 | Kurt |
| 4,719,709 | A | 1/1988 | Vaccari |
| 4,719,710 | A | 1/1988 | Pozzobon |
| 4,722,477 | A | 2/1988 | Floyd |
| 4,741,115 | A | 5/1988 | Pozzobon |
| 4,748,726 | A | 6/1988 | Schoch |
| 4,760,653 | A | 8/1988 | Baggio |
| 4,780,969 | A | 11/1988 | White, Jr. |
| 4,787,124 | A | 11/1988 | Pozzobon et al. |
| 4,790,081 | A | 12/1988 | Benoit et al. |
| 4,796,829 | A | 1/1989 | Pozzobon et al. |
| 4,799,297 | A | 1/1989 | Baggio et al. |
| 4,802,291 | A | 2/1989 | Sartor |
| 4,811,503 | A | 3/1989 | Iwama |
| 4,826,098 | A | 5/1989 | Pozzobon et al. |
| 4,841,649 | A | 6/1989 | Baggio et al. |
| 4,856,207 | A | 8/1989 | Datson |
| 4,870,723 | A | 10/1989 | Pozzobon et al. |
| 4,870,761 | A | 10/1989 | Tracy |
| 4,884,760 | A | 12/1989 | Baggio et al. |
| 4,937,953 | A | 7/1990 | Walkhoff |
| 4,961,544 | A | 10/1990 | Biodia |
| 5,001,817 | A | 3/1991 | De Bortoli et al. |
| 5,016,327 | A | 5/1991 | Klausner |
| 5,042,177 | A | 8/1991 | Schoch |
| 5,062,225 | A | 11/1991 | Gorza |
| 5,065,480 | A | 11/1991 | DeBortoli |
| 5,065,481 | A | 11/1991 | Walkhoff |
| 5,117,567 | A | 6/1992 | Berger |
| 5,129,130 | A | 7/1992 | Lecouturier |
| 5,152,038 | A | 10/1992 | Schoch |
| 5,157,813 | A | 10/1992 | Carroll |
| 5,158,428 | A | 10/1992 | Gessner et al. |
| 5,167,612 | A | 12/1992 | Bonutti |
| 5,177,882 | A | 1/1993 | Berger |
| 5,178,137 | A | 1/1993 | Goor et al. |
| 5,181,331 | A | 1/1993 | Berger |
| 5,184,378 | A | 2/1993 | Batra |
| D333,552 | S | 3/1993 | Berger et al. |
| 5,205,055 | A | 4/1993 | Harrell |
| 5,213,094 | A | 5/1993 | Bonutti |
| 5,249,377 | A | 10/1993 | Walkhoff |
| 5,259,094 | A | 11/1993 | Zepeda |
| 5,315,741 | A | 5/1994 | Debberke |
| 5,319,868 | A | 6/1994 | Hallenbeck |
| 5,325,613 | A | 7/1994 | Sussmann |
| 5,327,662 | A | 7/1994 | Hallenbeck |
| 5,335,401 | A | 8/1994 | Hanson |
| 5,341,583 | A | 8/1994 | Hallenbeck |
| 5,345,697 | A | 9/1994 | Quellais |
| 5,346,461 | A | 9/1994 | Heinz et al. |
| 5,355,596 | A | 10/1994 | Sussmann |
| 5,357,654 | A | 10/1994 | Hsing-Chi |
| 5,365,947 | A | 11/1994 | Bonutti |
| 5,381,609 | A | 1/1995 | Hieblinger |
| 5,395,304 | A | 3/1995 | Tarr et al. |
| 5,425,161 | A | 6/1995 | Schoch |
| 5,425,185 | A | 6/1995 | Gansler |
| 5,430,960 | A | 7/1995 | Richardson |
| 5,433,648 | A | 7/1995 | Frydman |
| 5,437,617 | A | 8/1995 | Heinz et al. |
| 5,456,268 | A | 10/1995 | Bonutti |
| 5,463,822 | A | 11/1995 | Miller |
| 5,477,593 | A | 12/1995 | Leick |
| 5,502,902 | A | 4/1996 | Sussmann |
| 5,511,325 | A | 4/1996 | Hieblinger |
| 5,535,531 | A | 7/1996 | Karabed et al. |
| 5,537,763 | A | 7/1996 | Donnadieu et al. |
| 5,557,864 | A | 9/1996 | Marks |
| 5,566,474 | A | 10/1996 | Leick et al. |
| 5,596,820 | A | 1/1997 | Edauw et al. |
| 5,599,000 | A | 2/1997 | Bennett |
| 5,599,288 | A | 2/1997 | Shirley et al. |
| 5,600,874 | A | 2/1997 | Jungkind |
| 5,606,778 | A | 3/1997 | Jungkind |
| 5,638,588 | A | 6/1997 | Jungkind |
| 5,640,785 | A | 6/1997 | Egelja |
| 5,647,104 | A | 7/1997 | James |
| 5,651,198 | A | 7/1997 | Sussmann |
| 5,669,116 | A | 9/1997 | Jungkind |
| 5,685,830 | A | 11/1997 | Bonutti |
| 5,718,021 | A | 2/1998 | Tatum |
| 5,718,065 | A | 2/1998 | Locker |
| 5,732,483 | A | 3/1998 | Cagliari |
| 5,736,696 | A | 4/1998 | Del Rosso |
| 5,737,854 | A | 4/1998 | Sussmann |

(56) References Cited

U.S. PATENT DOCUMENTS 5,755,044 A 5/1998 Veylupek
5,761,777 A 6/1998 Leick
5,772,146 A 6/1998 Kawamoto et al.
5,784,809 A 7/1998 McDonald
5,819,378 A 10/1998 Doyle
5,833,640 A 11/1998 Vazquez, Jr. et al.
5,891,061 A 4/1999 Kaiser
5,934,599 A 8/1999 Hammerslag
5,956,823 A 9/1999 Borel
6,032,387 A 3/2000 Johnson
6,038,791 A 3/2000 Cornelius et al.
6,052,921 A 4/2000 Oreck
6,070,886 A 6/2000 Cornelius et al.
6,070,887 A 6/2000 Cornelius et al.
6,102,412 A 8/2000 Staffaroni
6,119,318 A 9/2000 Maurer
6,128,836 A 10/2000 Barret
6,148,489 A 11/2000 Dickie et al.
6,202,953 B1 3/2001 Hammerslag
6,256,798 B1 7/2001 Egolf et al.
6,267,390 B1 7/2001 Maravetz et al.
6,289,558 B1 9/2001 Hammerslag
6,416,074 B1 7/2002 Maravetz et al.
6,464,657 B1 10/2002 Castillo
6,467,195 B2 10/2002 Pierre et al.
6,477,793 B1 11/2002 Pruitt et al.
6,543,159 B1 4/2003 Carpenter et al.
6,568,103 B2 5/2003 Durocher
6,685,662 B1 2/2004 Curry et al.
6,689,080 B2 2/2004 Castillo
6,694,643 B1 2/2004 Hsu
6,708,376 B1 3/2004 Landry
6,711,787 B2 3/2004 Jungkind et al.
6,757,991 B2 7/2004 Sussmann
6,775,928 B2 8/2004 Grande et al.
6,793,641 B2 9/2004 Freeman et al.
6,796,951 B2 9/2004 Freeman et al.
6,802,439 B2 10/2004 Azam et al.
6,877,256 B2 4/2005 Martin et al.
6,922,917 B2 8/2005 Kerns et al.
6,938,913 B2 9/2005 Elkington
6,942,632 B2 9/2005 Cho
6,945,543 B2 9/2005 De Bertoli et al.
6,962,571 B2 11/2005 Castillo
6,976,972 B2 12/2005 Bradshaw
6,993,859 B2 2/2006 Martin et al.
7,076,843 B2 7/2006 Sakabayashi
7,082,701 B2 8/2006 Dalgaard et al.
7,134,224 B2 11/2006 Elkington et al.
7,182,740 B1 2/2007 Castillo
7,198,610 B2 4/2007 Ingimundarson et al.
7,281,341 B2 10/2007 Reagan et al.
7,293,373 B2 11/2007 Reagan et al.
7,314,458 B2 1/2008 Bodenschatz
7,331,126 B2 2/2008 Johnson
7,367,522 B2 5/2008 Chen
7,386,947 B2 6/2008 Martin et al.
7,402,147 B1 7/2008 Allen
7,490,458 B2 2/2009 Ford
7,516,914 B2 4/2009 Kovacevich et al.
7,584,528 B2 9/2009 Hu
7,591,050 B2 9/2009 Hammerslag
7,597,675 B2 10/2009 Ingimundarson et al.
7,600,660 B2 10/2009 Kasper et al.
7,617,573 B2 11/2009 Chen
7,618,386 B2 11/2009 Nordt, III et al.
7,618,389 B2 11/2009 Nordt, III et al.
7,648,404 B1 1/2010 Martin
7,662,122 B2 2/2010 Sterling
7,694,354 B2 4/2010 Philpott et al.
7,704,219 B2 4/2010 Nordt, III et al.
7,713,225 B2 5/2010 Ingimundarson et al.
7,789,844 B1 9/2010 Allen
7,794,418 B2 9/2010 Ingimundarson et al.
7,806,842 B2 10/2010 Stevenson et al.
7,819,830 B2 10/2010 Sindel et al.
7,871,334 B2 1/2011 Young et al.
7,877,845 B2 2/2011 Signori
7,878,998 B2 2/2011 Nordt, III et al.
7,887,500 B2 2/2011 Nordt, III et al.
7,896,827 B2 3/2011 Ingimundarson et al.
7,900,378 B1 3/2011 Busse
7,908,769 B2 3/2011 Pellegrini
7,922,680 B2 4/2011 Nordt, III et al.
7,935,068 B2 5/2011 Einarsson
7,947,005 B2 5/2011 Castillo
7,950,112 B2 5/2011 Hammerslag et al.
7,954,204 B2 6/2011 Hammerslag et al.
7,992,261 B2 8/2011 Hammerslag et al.
7,993,296 B2 8/2011 Nordt, III et al.
8,016,781 B2 9/2011 Ingimundarson et al.
8,056,150 B2 11/2011 Stokes et al.
8,061,061 B1 11/2011 Rivas
8,074,379 B2 12/2011 Robinson, Jr. et al.
8,091,182 B2 1/2012 Hammerslag et al.
8,105,252 B2 1/2012 Rousso
8,109,015 B2 2/2012 Signori
8,128,587 B2 3/2012 Stevenson et al.
8,231,074 B2 7/2012 Hu et al.
8,231,560 B2 7/2012 Ingimundarson et al.
8,245,371 B2 8/2012 Chen
8,303,527 B2 11/2012 Joseph
8,353,088 B2 1/2013 Ha
8,381,362 B2 2/2013 Hammerslag et al.
8,424,168 B2 4/2013 Soderberg et al.
8,468,657 B2 6/2013 Soderberg et al.
8,713,820 B2 5/2014 Kerns et al.
8,832,912 B2 * 9/2014 Ha ..... A43C 11/165 24/712.9
9,101,181 B2 8/2015 Soderberg et al.
9,138,030 B2 9/2015 Soderberg et al.
9,259,056 B2 2/2016 Soderberg et al.
10,123,589 B2 11/2018 Soderberg et al.
10,413,019 B2 9/2019 Soderberg et al.
2002/0052568 A1 5/2002 Houser et al.
2002/0095750 A1 7/2002 Hammerslag
2002/0178548 A1 12/2002 Freed
2003/0041478 A1 3/2003 Liu
2003/0051374 A1 3/2003 Freed
2003/0177662 A1 9/2003 Elkington et al.
2003/0204938 A1 11/2003 Hammerslag
2005/0054962 A1 3/2005 Bradshaw
2005/0081403 A1 4/2005 Mathieu
2005/0087115 A1 4/2005 Martin
2005/0098673 A1 5/2005 Huang
2005/0102861 A1 5/2005 Martin
2005/0126043 A1 6/2005 Reagan et al.
2005/0198866 A1 9/2005 Wiper et al.
2005/0273025 A1 12/2005 Houser
2006/0156517 A1 7/2006 Hammerslag et al.
2006/0179685 A1 8/2006 Borel et al.
2006/0185193 A1 8/2006 Pellegrini
2007/0113524 A1 5/2007 Lander
2007/0128959 A1 6/2007 Cooke
2007/0169378 A1 7/2007 Soderberg et al.
2007/0276306 A1 11/2007 Castillo
2008/0060167 A1 3/2008 Hammerslag et al.
2008/0060168 A1 3/2008 Hammerslag et al.
2008/0066272 A1 3/2008 Hammerslag et al.
2008/0066345 A1 3/2008 Hammerslag et al.
2008/0066346 A1 3/2008 Hammerslag et al.
2008/0083135 A1 4/2008 Hammerslag et al.
2008/0092279 A1 4/2008 Chiang
2008/0172848 A1 7/2008 Chen
2009/0099562 A1 4/2009 Ingimundarson et al.
2009/0124948 A1 5/2009 Ingimundarson et al.
2009/0172928 A1 7/2009 Messmer et al.
2009/0184189 A1 7/2009 Soderberg
2009/0287128 A1 11/2009 Ingimundarson et al.
2010/0081979 A1 4/2010 Ingimundarson et al.
2010/0094189 A1 4/2010 Ingimundarson et al.
2010/0101061 A1 4/2010 Ha
2010/0139057 A1 6/2010 Soderberg et al.
2010/0154254 A1 6/2010 Fletcher

(56) References Cited

U.S. PATENT DOCUMENTS

| | | | |
|---|---|---|---|
| 2010/0174221 | A1 | 7/2010 | Ingimundarson et al. |
| 2010/0175163 | A1 | 7/2010 | Litke |
| 2010/0217169 | A1 | 8/2010 | Ingimundarson |
| 2010/0251524 | A1 | 10/2010 | Chen |
| 2010/0319216 | A1 | 12/2010 | Grenzke et al. |
| 2010/0331750 | A1 | 12/2010 | Ingimundarson |
| 2011/0000173 | A1 | 1/2011 | Lander |
| 2011/0004135 | A1 | 1/2011 | Kausek |
| 2011/0071647 | A1 | 3/2011 | Mahon |
| 2011/0098618 | A1 | 4/2011 | Fleming |
| 2011/0099843 | A1 | 5/2011 | Jung |
| 2011/0144554 | A1 | 6/2011 | Weaver, II et al. |
| 2011/0167543 | A1 | 7/2011 | Kovacevich et al. |
| 2011/0178448 | A1 | 7/2011 | Einarsson |
| 2011/0184326 | A1 | 7/2011 | Ingimundarson et al. |
| 2011/0191992 | A1 | 8/2011 | Chen |
| 2011/0218471 | A1 | 9/2011 | Ingimundarson et al. |
| 2011/0266384 | A1 | 11/2011 | Goodman et al. |
| 2011/0288461 | A1 | 11/2011 | Arnould et al. |
| 2011/0301521 | A1 | 12/2011 | Weissenbock et al. |
| 2011/0306911 | A1 | 12/2011 | Tran |
| 2012/0000091 | A1 | 1/2012 | Cotterman et al. |
| 2012/0004587 | A1 | 1/2012 | Nickel et al. |
| 2012/0005995 | A1 | 1/2012 | Emery |
| 2012/0010547 | A1 | 1/2012 | Hinds |
| 2012/0029404 | A1 | 2/2012 | Weaver, II et al. |
| 2012/0101417 | A1 | 4/2012 | Joseph |
| 2012/0167290 | A1 | 7/2012 | Kovacevich et al. |
| 2012/0246974 | A1 | 10/2012 | Hammerslag et al. |
| 2013/0012856 | A1 | 1/2013 | Hammerslag et al. |
| 2013/0025100 | A1 | 1/2013 | Ha |
| 2015/0101160 | A1 | 4/2015 | Soderberg et al. |
| 2015/0342303 | A1 | 12/2015 | Soderberg et al. |

FOREIGN PATENT DOCUMENTS

| | | | |
|---|---|---|---|
| CA | 2112789 | | 8/1994 |
| CA | 2114387 | | 8/1994 |
| CH | 41765 | | 9/1907 |
| CH | 111341 | | 11/1925 |
| CH | 199766 | | 11/1938 |
| CH | 204 834 | A | 8/1939 |
| CH | 562 015 | | 5/1975 |
| CH | 577 282 | | 7/1976 |
| CH | 612 076 | | 7/1979 |
| CH | 537 164 | | 7/1981 |
| CH | 624 0001 | | 7/1981 |
| CH | 471 553 | | 12/1984 |
| DE | 555211 | | 7/1932 |
| DE | 641976 | | 2/1937 |
| DE | 1 661 668 | | 8/1953 |
| DE | 7045778.2 | | 3/1971 |
| DE | 1 785 220 | | 5/1971 |
| DE | 2 062 795 | | 6/1972 |
| DE | 7047038 | | 1/1974 |
| DE | 23 41 658 | | 3/1974 |
| DE | 24 14 439 | | 10/1975 |
| DE | 29 00 077 | A1 | 7/1980 |
| DE | 29 14 280 | A1 | 10/1980 |
| DE | 31 01 952 | A1 | 9/1982 |
| DE | 81 01 488.0 | | 7/1984 |
| DE | 38 13 470 | | 11/1989 |
| DE | 3822113 | C2 | 1/1990 |
| DE | 9005496 | U1 | 12/1991 |
| DE | 43 02 401 | A1 | 8/1994 |
| DE | 94 13 147 | U | 10/1994 |
| DE | 9315776 | | 2/1995 |
| DE | 29503552.8 | | 4/1995 |
| DE | 196 24 553 | | 1/1998 |
| DE | 19945045 | A1 | 3/2001 |
| DE | 201 16 755 | | 1/2002 |
| EP | 0297342 | | 1/1989 |
| EP | 0 393 380 | | 10/1990 |
| EP | 0 589 232 | | 3/1994 |
| EP | 0 589 233 | | 3/1994 |
| EP | 0 614 624 | | 9/1994 |
| EP | 0 614 625 | | 9/1994 |
| EP | 0 651 954 | A1 | 5/1995 |
| EP | 0 693 260 | | 1/1996 |
| EP | 0 734 662 | | 10/1996 |
| EP | 1 236 412 | | 9/2002 |
| EP | 2052636 | A1 | 4/2009 |
| EP | 2359708 | | 8/2011 |
| FR | 1 349 832 | | 1/1964 |
| FR | 1 374 110 | | 10/1964 |
| FR | 1 404 799 | | 7/1965 |
| FR | 2 019 991 | A | 7/1970 |
| FR | 2 108 428 | | 5/1972 |
| FR | 2 173 451 | | 10/1973 |
| FR | 2 175 684 | | 10/1973 |
| FR | 2 399 811 | | 3/1979 |
| FR | 2 565 795 | | 12/1985 |
| FR | 2 598 292 | | 11/1987 |
| FR | 7 726 440 | | 5/1996 |
| FR | 2 770 379 | | 5/1999 |
| FR | 2 814 919 | | 4/2002 |
| GB | 189911673 | | 7/1899 |
| GB | 216400 | | 5/1924 |
| GB | 2 449 722 | A | 12/2008 |
| IT | 1220811 | | 6/1990 |
| IT | 2003 A 000197 | | 4/2003 |
| IT | 2003 A 000198 | | 3/2005 |
| JP | 8-9202 | | 6/1933 |
| JP | 49-28618 | | 3/1974 |
| JP | 51-2776 | | 1/1976 |
| JP | 51-121375 | | 10/1976 |
| JP | 51-131978 | | 10/1976 |
| JP | 53-124987 | | 3/1977 |
| JP | 54-108125 | | 2/1978 |
| JP | 62-57346 | | 4/1987 |
| JP | 63-80736 | | 5/1988 |
| JP | 3031760 | | 3/1991 |
| JP | 7-000208 | | 6/1995 |
| JP | 3030988 | | 11/1996 |
| JP | 10-199366 | | 7/1998 |
| JP | 2004-016732 | | 1/2004 |
| JP | 2004-041666 | | 2/2004 |
| KR | 20-0367882 | | 11/2004 |
| KR | 20-0400568 | | 11/2005 |
| KR | 10-0598627 | | 7/2006 |
| KR | 1020100111031 | | 10/2010 |
| WO | 94/27456 | | 12/1994 |
| WO | 1995/03720 | | 2/1995 |
| WO | 98/37782 | | 9/1998 |
| WO | 099/15043 | | 4/1999 |
| WO | 00/53045 | | 9/2000 |
| WO | 2000/76337 | | 12/2000 |
| WO | 01/08525 | | 2/2001 |
| WO | 07/016983 | | 2/2007 |

OTHER PUBLICATIONS

U.S. Appl. No. 09/956,601, filed Sep. 18, 2001, Hammerslag.

Asolo® Boot Brochure Catalog upon information and belief date is as early as Aug. 22, 1997, 12 pages.

La Sportiva, A Technical Lightweight Double Boot for Cold Environments, 1 page. Accessed on May 27, 2015. Retrieved from http://www.sportiva.com/products/footwear/mountain/spantik.

"Strength of materials used to make my Safety Harnesses," Elaine, Inc. Jul. 9, 2012. Retrieved from <https://web.archive.org/web/20120709002720/http://www.childharness.ca/strength_data.html> on Mar. 17, 2014, 2 pages.

International Search Report and Written Opinion for PCT/US2013/032326 dated Jun. 14, 2013, 27 pages.

International Preliminary Report on Patentability for PCT/US2013/032326 dated Sep. 16, 2014, 6 pages.

International Search Report and Written Opinion for PCT/US2013/057637 dated Apr. 7, 2014, 34 pages.

International Preliminary Report on Patentability for PCT/US2013/057637 dated Mar. 3, 2015, 9 pages.

International Search Report and Written Opinion for PCT/US2013/068342 dated Apr. 7, 2014, 29 pages.

(56) References Cited

OTHER PUBLICATIONS

International Preliminary Report on Patentability for PCT/US2013/068342 dated May 5, 2015, 9 pages.
International Search Report and Written Opinion for PCT/US2014/014952 dated Apr. 25, 2014, 17 pages.
International Preliminary Report on Patentability for PCT/US2014/014952 dated Aug. 11, 2015, 9 pages.
International Search Report and Written Opinion for PCT/US2014/066212 dated Apr. 22, 2015, 16 pages.
International Search Report and Written Opinion for PCT/US2014/032574 dated Oct. 31, 2014, 19 pages.
International Search Report and Written Opinion for PCT/US2014/045291 dated Nov. 6, 2014, 12 pages.
International Search Report and Written Opinion for PCT/US2014/013458 dated May 19, 2014, 12 pages.
International Preliminary Report on Patentability for PCT/US2014/013458 dated Jul. 28, 2015, 7 pages.
International Search Report and Written Opinion for PCT/US2013/068814 dated Jun. 9, 2014, 18 pages.
International Preliminary Report on Patentability for PCT/US2013/068814 dated May 12, 2015, 12 pages.
Notice of Reasons for Rejection from the Japanese Patent Office dated Feb. 26, 2015 for design application No. 2014-015570, 4 pages.
Receipt of Certificate of Design Registration No. 1529678 from the Japanese Patent Office for design application No. 2014-015570 dated Jun. 26, 2015, 1 page.
International Search Report and Written Opinion for PCT/US2014/055710 dated Jul. 6, 2015, 19 pages.
International Search Report and Written Opinion for PCT/US2014/054420 dated Jul. 6, 2015, 21 pages.
The Preliminary Rejections from the Korean Intellectual Property Office for Application No. 30-2014-34959 dated Aug. 7, 2015, is not translated into English. The document requests a renaming of the application to be in accordance with Korean patent law, 5 pages total.
The Preliminary Rejections from the Korean Intellectual Property Office for Application No. 30-2014-34959 dated Apr. 7, 2015, is not translated into English. The document requests a revision of the drawings to be in accordance with Korean patent law, 6 pages total.
Certificate of Design Registration No. 30-809409 on Aug. 3, 2015 from the Korean Intellectual Property Office for Appln No. 30-2015-11475, 2 pages.
Certificate of Design Registration No. 30-809410 on Aug. 3, 2015 from the Korean Intellectual Property Office for Appln No. 30-2015-11476, 2 pages.
European Search Report for EP 14168875 dated Oct. 29, 2014, 9 pages.
International Search Report and Written Opinion for PCT/US2014/020894 dated Jun. 20, 2014, 12 pages.
International Preliminary Report on Patentability for PCT/US2014/020894 dated Sep. 8, 2015, 7 pages.
International Search Report and Written Opinion for PCT/US2014/041144 dated Dec. 10, 2014, 13 pages.
International Preliminary Report on Patentability for PCT/US2014/032574 dated Oct. 6, 2015, 12 pages.
International Search Report and Written Opinion for PCT/US2014/046238 dated Nov. 21, 2014, 17 pages.
Office Action dated Oct. 8, 2015 from the German Patent and Trademark Office for Appln No. 402015100191.2, regarding the title of the invention, 2 pages.
Anonymous, "Shore durometer," Wikipedia, the free encyclopedia, Mar. 10, 2012, XP002747470, Retrieved from the Internet: URL: https://en.wikipedia.org/w/index.php?title=Shore_durometer&oldid=481128180 [retrieved on Oct. 20, 2015] * shore A, shore D, durometer, polymer, rubber, gel; the whole document *, 6 pages.
Notice of Reasons for Rejection from the Japanese Patent Office dated Oct. 5, 2015 for design application No. 2015-004923, 4 pages.
"Save Tourniquet," 3 pages. Copyright 2015. Accessed on Dec. 11, 2015. Retrieved from http://www.savetourniquet.com/.
International Preliminary Report on Patentability for PCT/US2014/041144 dated Dec. 8, 2015, all pages.
Supplementary European Search Report for EP 13761841 dated Oct. 21, 2015, all pages.

* cited by examiner

REEL-BASED LACING SYSTEM

CROSS-REFERENCE TO RELATED APPLICATIONS

This application is a continuation of U.S. patent application Ser. No. 14/821,556, filed Aug. 7, 2015, which is a continuation of U.S. patent application Ser. No. 13/273,060, filed Oct. 13, 2011, issued as U.S. Pat. No. 9,101,181 on Aug. 11, 2015, the entire disclosures of which are hereby incorporated by reference, for all purposes, as if fully set forth herein.

BACKGROUND

Field

Embodiments of the present disclosure relate to lacing or closure systems and their related components used alone or in combination with a variety of articles including footwear, closable bags, protective gear, other wearable articles, etc.

Description of the Related Art

There currently exist a number of mechanisms and methods for tightening articles. Nevertheless, there remains a need for improved tightening devices and methods.

SUMMARY

A reel for use with a lacing system is disclosed. The reel can include a housing and a spool that is rotatable about an axis relative to the housing. The spool can be configured to gather lace when the spool is rotated in a first direction and to release lace when the spool is rotated in a second direction. The reel can include a lace retaining element configured to retain the lace radially inward as the spool rotates in the second direction.

The spool can include a channel configured to receive the gathered lace and the lace retaining element can include a narrowed region of the channel. The spool can include a first disc member and a second disc member spaced apart from the first disc member such that the channel is formed between the first and second disc members, and the first disc member can include at least one detent that extends from an inside surface of the first disc member towards the second disc member to form the at least one narrow region of the channel. The at least one detent can be formed at a radially outer portion of the first disc member. In some embodiments, a portion of the spool can be displaced such that the distance between the at least one detent and the second disc member can increase to prevent the lace from being trapped in the narrow region of the channel. The first disc member can include at least one groove configured to allow a portion of the first disc member that includes the detent to flex away from the second disc member when the lace engages the detent to prevent the lace from being trapped by the narrow region.

In some embodiments, the housing includes an inner wall surface, and wherein the lace retaining element is configured to prevent the lace from contacting the inner wall surface of the housing as the spool rotates in the second direction.

The reel can include a mounting flange configured to removably attach to a mounting base, and the mounting base can be configured to be secured to an article. The mounting base can include a bore, and the mounting flange can include a hole. A fastener can be configured to pass through the hole and engage the bore to secure the mounting flange to the mounting base.

A reel for use in a lacing system is disclosed. The reel can include a housing and a spool rotatable with respect to the housing. The spool can be configured to gather lace when the spool is rotated in a first direction and to release lace when the spool is rotated in a second direction. The reel can include a plurality of teeth and at least one pawl configured to engage the plurality of teeth. The at least one pawl can include a pawl arm having an unrestrained end portion, and the at least one pawl can include a cap member configured to fit over the unrestrained end portion of the pawl arm such that the cap member of the pawl contacts the plurality of teeth.

The plurality of teeth and the at least one pawl can be configured to allow the spool to rotate in the first direction and to prevent the spool from rotating in the second direction when the at least one pawl is engaged with the teeth. The reel can include at least one drive member movable to engage the at least one pawl and displace the unrestrained end portion of the pawl arm away from the teeth to allow the spool to rotate in the second direction. The reel can be configured such that when the drive member displaces the unrestrained end portion of the pawl arm away from the teeth, the spool rotates in the second direction by an incremental amount and the pawl reengages the teeth, thereby providing an incremental release of the lace. The reel can further include a knob, and the knob can include the drive members.

The at least one pawl can be coupled to the spool, and the teeth can be coupled to the housing. The at least one pawl can be removably attachable to the spool such that in the attached position the pawl rotates with the spool. The reel can have four pawls.

In some embodiments, the pawl arm comprises a first material and the cap member comprises a second material, and the second material can be harder than the first material. The first material can be acetal polyoxymethylene (POM) plastic material, and the second material can be brass or steel.

A reel for use in a lacing system is disclosed. The reel can include a housing and a spool rotatable with respect to the housing. The spool can be configured to gather lace when the spool is rotated in a first direction and to release lace when the spool is rotated in a second direction. The reel can include an engagement member having at least one pawl, and the engagement member can be configured to be removably attachable to the spool such that in the attached configuration the engagement member rotates with the spool. The reel (e.g., the reel housing) can also include a plurality of teeth configured to engage with the at least one pawl.

The plurality of teeth and the at least one pawl can be configured to allow the spool to rotate in the first direction and to prevent the spool from rotating in the second direction when the at least one pawl is engaged with the teeth. The reel can include at least one drive member movable to engage the at least one pawl and displace an unrestrained end portion of the pawl arm away from the teeth to allow the spool to rotate in the second direction. The reel can be configured such that when the drive member displaces the unrestrained end portion of the pawl arm away from the teeth, the spool rotates in the second direction by an incremental amount and the pawl reengages the teeth, thereby providing an incremental release of the lace.

The teeth can be coupled to the housing. The spool can include a first material and the engagement member can include a second material that is different than the first material. The first material can be a glass filled nylon material, and the second material can be an acetal polyoxymethylene (POM) plastic material.

A reel for use with a lacing system is disclosed. The reel can include a housing and a spool rotatable with respect to the housing. The spool can be configured to gather lace when the spool is rotated in a first direction and to release lace when the spool is rotated in a second direction. The reel can include a plurality of teeth and at least one pawl configured to engage the plurality of teeth. The reel can include one or more depressions configured to collect debris so as to divert the debris away from an interface between the at least one pawl and the plurality of teeth.

DETAILED DESCRIPTION OF THE PREFERRED EMBODIMENT

Figure 1:
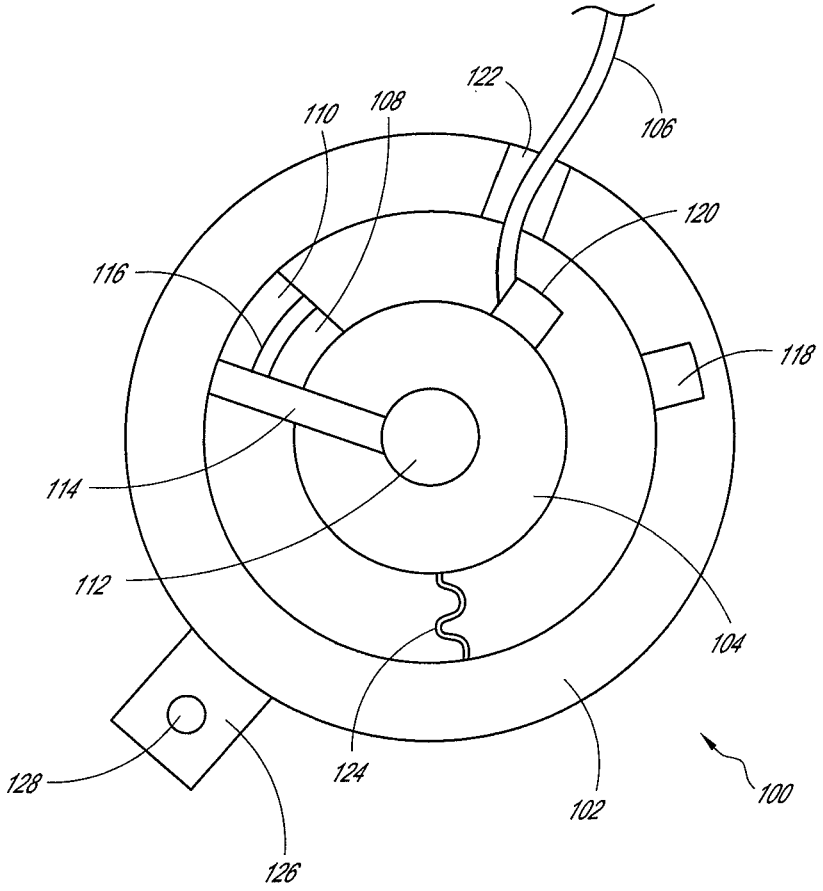
FIG. 1 is a schematic illustration of a reel for use in a lacing system.

FIG. 1 schematically illustrates an example embodiment of a reel 100 for use with a lacing system. The reel 100 can include a housing 102, and a spool 104 that rotates relative to the housing 102 to adjust the tension on a lace 106. The spool 104 can be coupled to a first engagement member 108 and the housing 102 can be coupled to a second engagement member 110. The first and second engagement members 108, 110 can interface with each other to limit or otherwise influence the rotation of the spool 104 relative to the housing 102. For example, the engagement members 108, 110 can allow the spool 104 to rotate substantially unimpeded in a first direction so as to gather lace 106 into the reel 100, and the engagement members 108, 110, when engaged with each other, can prevent the spool 104 from rotating in a second direction that releases lace 106 from the reel 100. In some embodiments, the first engagement member 108 can be removably attachable to the spool 104 so that the first engagement member 108 can be formed of a different material than the spool 104 and/or so that the first engagement member 108 can be replaced without replacing (or removing) the spool 104. In some embodiments, the first engagement member 108 can include one or more pawls, and the second engagement member 110 can include a plurality of teeth.

The reel 100 can include a knob 112 that can be configured to control rotation of the spool 104. For example, manipulating the knob 112 in a first manner (e.g., rotation of the knob 112 in a first direction) can cause the spool 104 to rotate in the first direction, thereby gathering lace into the reel 100, and the engagement members 108, 110 can incrementally lock the spool 104 against rotation in the second direction. In some embodiments, manipulating the knob 112 in a second manner (e.g., rotation of the knob 112 in the second direction) can cause the engagement members 108, 110 to disengage from each other to allow the spool 104 to rotate in the second direction, thereby releasing lace 106 from the reel 100. In some embodiments, the engagement members 108, 110 can be configured to reengage after the spool 104 has rotated a predetermined amount in the second direction, thereby locking the spool 104 against further loosening until the knob 112 is again manipulated in the second manner. Thus, the reel 100 can provide for incremental release of the lace 106 from the reel 100. In some embodiments, the reel 112 can include one or more drive members 114, which can be integral to, or coupled to, the knob 112, and which can interface with the spool 104, the first engagement member 108, and/or the second engagement member 110 to control rotation of the spool 104.

In some embodiments, the repeated interfacing between the engagement members 108, 110 can cause one or both of the engagement members 108, 110 to wear down during use, particularly under high loads while moving in the loosening direction and when dirt is present in the reel 100. In some cases, the wear can shorten the useful life of the reel, or it can cause the reel 100 to fail. Unexpected failure of the reel 100 can result in undesired and even sudden loss of tension in the lacing system, which can compromise an athlete's performance. In some embodiments, a reel 100 that provides for incremental release of the lace 106 can be subject to additional wear on the engagement members 108, 110 because of the repeated disengagement and reengagement of the engagement members 108, 110 during loosening. Also, in some applications, especially during sports, debris can enter the reel 100. The debris can be abrasive to the engagement members 108, 110 and can accelerate the rate of wear. In some embodiments, a protection element 116 can be provided to increase the durability of one or both of the engagement members 108, 110. For example, the protection element 116 can be a metal (or other suitably durable) cap that is placed on the portion of a pawl that interfaces with the teeth.

In some embodiments, the reel 100 can include a debris diverter 118 that can be configured to move debris away from the interface between the engagement members 108, 110. The debris diverter 118 can be configured to move debris away from other components of the reel 100 as well, such as the interface between the lace 106 and the spool 104 or the interface between the spool 104 and the housing 102. Thus, the debris diverter 118 can reduce wear on the components of the reel 100 and can prevent the reel 100 from jamming (e.g., due to debris locking up the spool 104 or blocking the lace 106).

In some embodiments, the reel can include a lace retaining element 120 that can be configured to retain the lace 106 away from the walls of the housing 102 to prevent the lace 106 from backing up inside the reel 100. In some embodiments, if the lace 106 is loosened when no tension is placed on the lace 106, the lace 106 can tend to unwind inside the reel 100 and move radially outward away from the rotational axis of the spool 104. If the lace 106 moves radially outward and contacts the inner wall of the housing 102, friction between the housing 102 and the lace 106 can cause the lace to double back on itself inside the reel 100. In some embodiments, the lace retaining element 120 can be configured to hold the lace 106 off of the housing 102 wall as the lace 106 is loosened, thereby facilitating the exiting of the lace 106 through the hole 122 during loosening. For example, the lace retaining element can include detents forming a narrow region on the radially outer portion spool 104 so that the lace 106 engages the narrow region when it moves radially outward, thereby retaining the lace 106 away from the wall of the housing 102.

In some embodiments, the reel 100 can include a rotation limiter 124. The rotation limiter can be configured to prevent the spool 104 from being rotated too far in the first direction and/or in the second direction. If too much lace 106 is drawn into the reel 100, the lace 106 can jam the reel 100. If the spool 104 is rotated in the second direction when the lace 106 is fully loose, the reel 100 can start to start to gather lace 106 in the wrong direction. The rotation limiter can be, for example, a stop cord that is coupled to the housing 102 and to the spool 104 such that rotation of the spool 104 takes up slack in the stop cord (e.g., by winding the stop cord around a channel on the spool 104 or around a pin or other structure of the housing 102). When the stop cord becomes tight, the spool 104 is prevented from further rotation. The length of the stop cord can be selected such that the stop cord is fully tight and wound in a first direction when the lace 106 is fully tight, thereby preventing over tightening, and so that the stop cord is fully tight and wound in a second direction when the lace 106 is fully loose, to prevent the lace 106 from being gathered the wrong way on the spool 104.

The reel 100 can include a mounting member 126. In some embodiments, the mounting member 126 can a flange that is configured to be sewn, adhered, or otherwise coupled to an article (e.g., a shoe). In some embodiments, the mounting member 126 can be configured to removably attach to a base member (not shown) on the article so that the reel 100 can be removed from the article, such as for repair or replacement of the reel 100. The mounting member 126 can include a hole 128 that receives a fastener (e.g., a bolt) that secures the mounting member 126 to the base member on the article.

Although the embodiments described herein may be described as having various features integrated into a single reel (e.g., the incremental release, protection element 116, debris diverter 118, lace retaining element 120, rotation limiter 124, and removable mounting member 126 of the reel 100 of FIG. 1), other embodiments can be made to use only one of the described features, or any combination of the described features. Also, additional features can be incorporated into the reels described herein in addition to the features specifically described.

Figure 2:
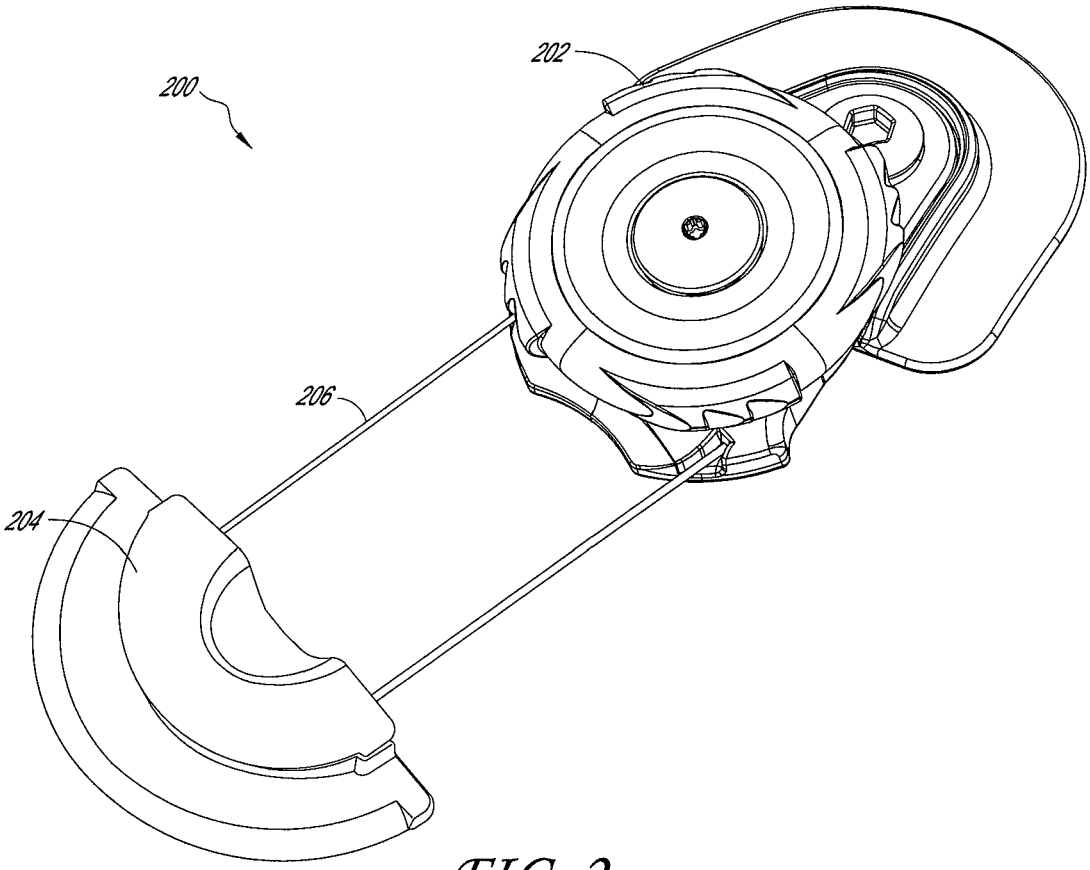
FIG. 2 is a perspective view of a lacing system.

FIG. 2 is a perspective view of an example embodiment of a lacing system 200. The lacing system 200 can include a reel 202, at least one lace guide 204, and a lace 206 that extends between the reel 202 and the lace guide 204. The reel 202 can be configured to gather lace 206 to draw the lace guide 204 closer to the reel 202 and tighten the lacing system 200, and the reel 202 can be configured to release lace 206 to loosen the lacing system 200. Although only one lace guide 204 is shown in FIG. 2, any suitable number of lace guides 204 (e.g., 2, 3, 5, etc.) can be used.

In some embodiments, the lace 206 can be a highly lubricious cable or fiber having a high modulus of elasticity and a high tensile strength. In some embodiments, the cable can have multiple strands of material woven together. While any suitable lace can be used, some embodiments can utilize a lace formed from extended chain, high modulus polyethylene fibers. In some embodiments, SPECTRA™ fiber (manufactured by Honeywell of Morris Township, N.J.) can be used. In some embodiments, the lace can be formed from a molded monofilament polymer. The lace or cable can have a diameter of at least about 0.02 inches and/or no more than about 0.04 inches, or at least about 0.025 inches and/or nor more than about 0.035 inches, although diameters outside these ranges can also be used. The lace can be made of high modulus fibers that advantageously have a high strength to weight ratio, are cut resistant, and/or have very low elasticity. The lace can be formed of tightly woven fibers to provide added stiffness to the lace. In some embodiments, the lace can have enough column strength that the lace can be easily threaded through the lace guides, and into the reel and spool, or through the guides so as to form a loop of lace that can be easily grasped by a user. In some embodiments, the lace can have enough column strength that the lace can be pushed out of the reel without doubling back on itself, as discussed elsewhere herein.

Figure 3:
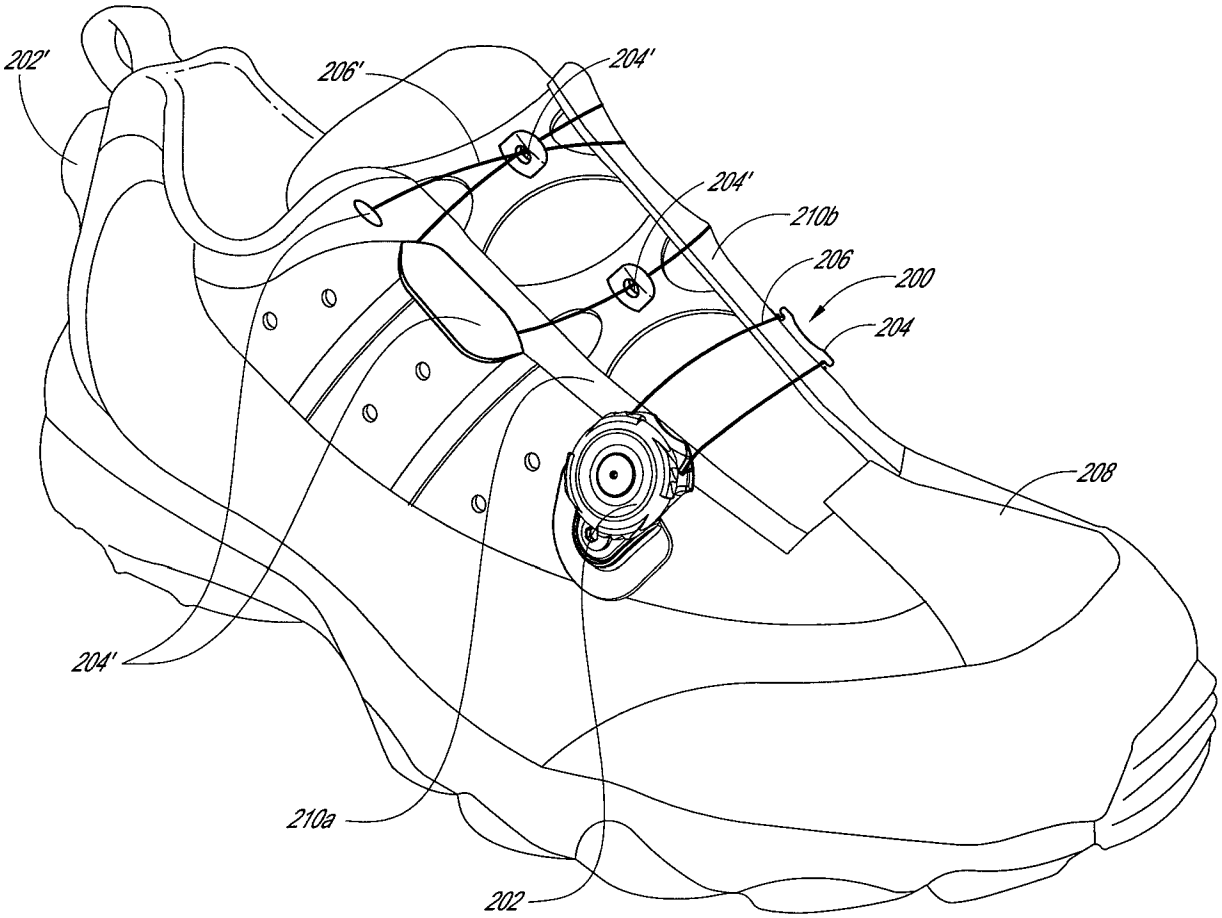
FIG. 3 is a perspective view of the lacing system of FIG. 2 incorporated into a shoe.

FIG. 3 is a perspective view of the lacing system 200 incorporated into a sports shoe 208. The lacing system 200 can also be incorporated into any other suitable articles including, but not limited to, cycling shoes, boots, other footwear, belts, hats, gloves, braces, helmets, boot bindings, backpacks, or other suitable wearable articles, or any other item in which two portions are to be selectively drawn together and loosened. The shoe 208 can have a first side 210*a* and a second side 210*b*, and the lacing system 200 can extend between the sides 210*a*, 210*b*. Thus, when the lace 206 of the lacing system 200 is tightened, the sides 210*a*, 210*b* of the shoe 208 are drawn together, and when the lace 206 is loosened, the sides 210*a*, 210*b* of the shoe 208 are allowed to move apart. In the illustrated embodiment, the shoe 208 has a second reel 202' mounted to the heel portion of the shoe 208. The second reel 202' can be similar to, or the same as, the first reel 202. The second lace 206' can pass along a channel through the shoe 208 to the lace guides 204'. The second reel 202' can be configured to tighten a second lace 206' on an upper zone of the shoe 208, and the reel 202 can tighten a lower zone of the shoe 208. Many variations are possible. For example, a single reel can be used to adjust a single lace that extends through the full set of lace guides 204, 204', or more than two reels can be used. A reel can be mounted onto tongue of the shoe 208, or on the side or heel (as shown in FIG. 3), or on any other suitable portion of the article. In some embodiments, the article can include one or more straps and reels or lace guides can be mounted onto the strap. In some embodiments, a lace guide can be coupled (e.g., integrally formed, removably attached, or permanently attached) to a reel.

Figure 4:
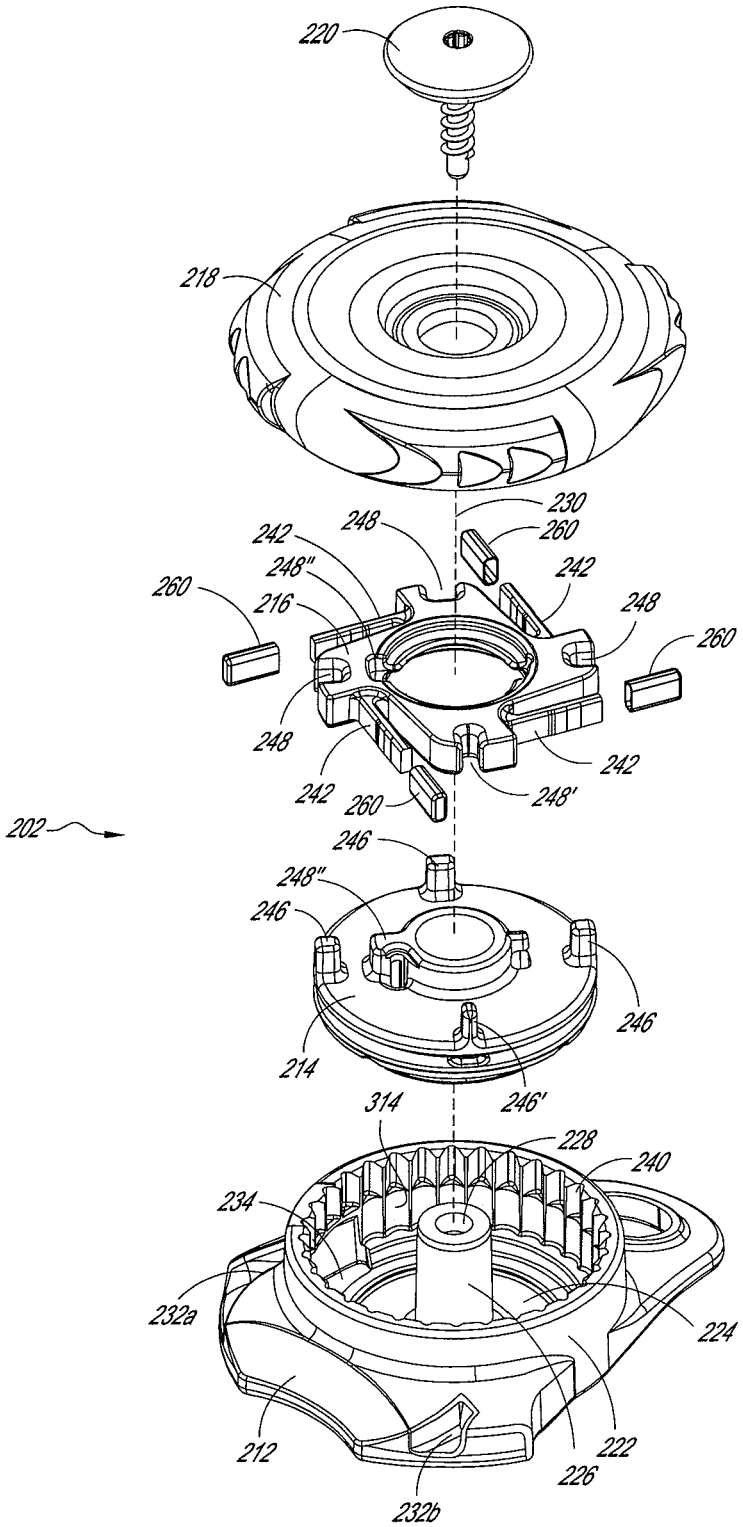
FIG. 4 is an exploded top perspective view of a reel of the lacing system of FIG. 2.
Figure 5:
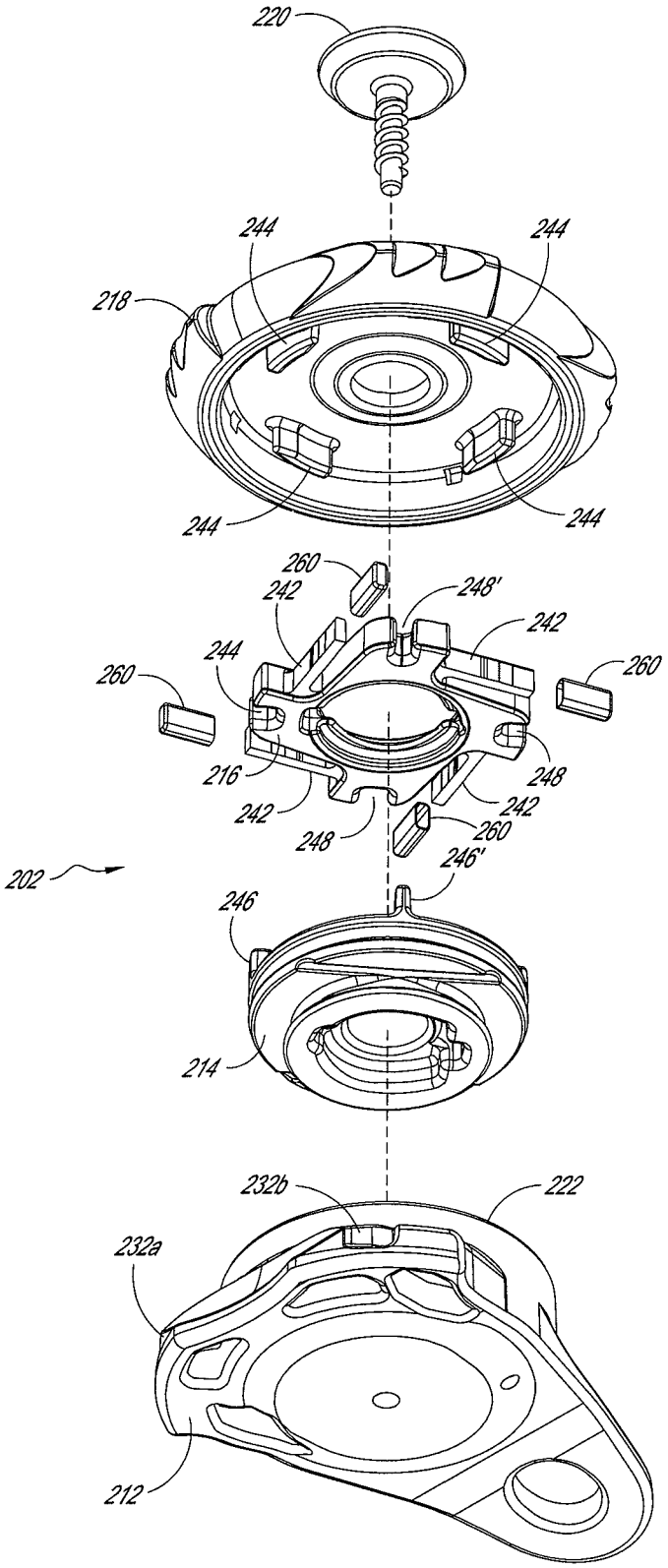
FIG. 5 is a an exploded bottom perspective view of the reel of FIG. 4.

FIG. 4 is an exploded perspective top view of the reel 202, and FIG. 5 is an exploded perspective bottom view of the reel 202. The reel 202 can include a housing 212, a spool 214, an engagement member 216, a knob 218, and a fastener 220. The housing 212 can include a generally cylindrical wall 222 that surrounds a depression 224 formed in the housing 212. A shaft 226 can extend upward from a central portion of the depression 224, and the shaft can have a bore 228 configured to receive the fastener 220. For example, the fastener can be a threaded screw, and the bore 228 can be threaded so as to engage the screw. The spool 214, engagement member 216, and knob 218 can be secured to the housing 212 by the fastener 220 such that the spool 214, engagement member 216, and knob 218 can rotate about an axis 230 with respect to the housing 212. In some embodiments, the fastener 220 is removably attachable to the housing 212 so that the fastener 220 can be removed to permit disassembly of the reel 202 (e.g., for repair or cleaning). Other configurations are possible. For example, the fastener 220 can be a rivet, bolt, or any other type of fastener suitable for securing the spool 214, engagement member 216, and/or knob 218 to the housing 212.

Figure 7:
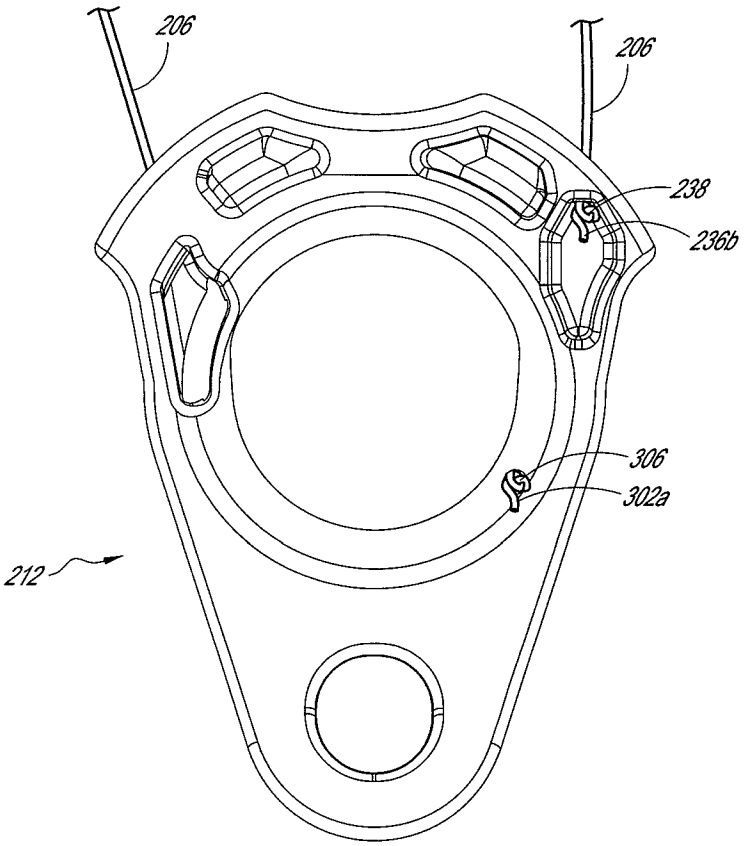
FIG. 7 is a bottom view of the housing of FIG. 6.
Figure 6:
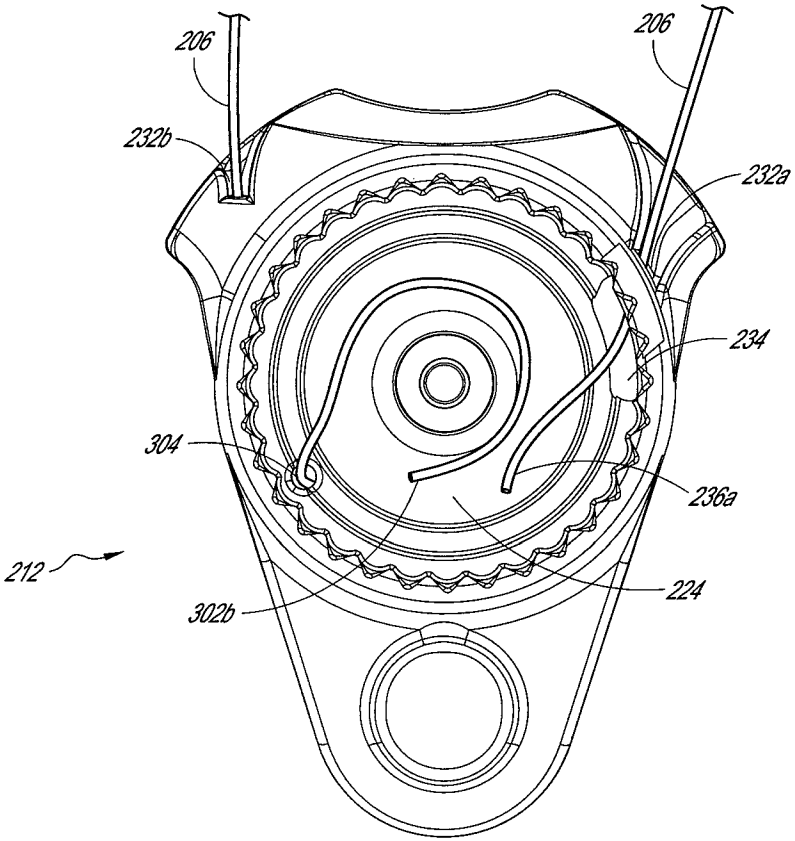
FIG. 6 is a top view of a housing of the reel of FIG. 4.

FIG. 6 is a top view of the housing 212, and FIG. 7 is a bottom view of the housing 212. With reference to FIGS. 4-7, the housing 212 can include a first lace hole 232*a* configured to allow the lace 206 to move in an out of the reel 202. The first lace hole 232*a* can lead to an opening 324 in the side wall 222 to allow the lace 206 to pass from outside the reel, through the housing 212, and into the depression 224. A first end 236*a* of the lace 206 can be secured to the spool 214, as discussed elsewhere herein, such that winding of the spool 214 in a tightening direction draws lace 206 into the reel 202 through the lace hole 232*a*. Once a portion of the lace 206 has been gathered into the reel 100, winding the spool 214 in a loosening direction can release the lace 206 and allow it to exit the reel 202 through the lace hole 232*a*. In some embodiments, the housing 212 includes a second lace hole 232*b* that is configured to receive a second end 236*b* of the lace 206. The second end 236*b* of the lace 206 can be secured to the housing 212, by a knot 238, by a securing mechanism, by a friction fit, or by any other suitable manner. Thus, when lace 206 is drawn into the reel 202 through the first lace hole 232*a*, the lacing system 200 is tightened, and when lace 206 is released from the reel through the lace hole 232*a*, the lacing system 200 is loosened. Many alternatives are possible. For example, in some embodiments, the lace holes 232*a*, 232*b* can allow both lace ends 236*a*, 236*b* to enter the depression 224 and secure to the spool 214. In some embodiments, the second end 236*b* of the lace 206 can be secured to an external portion of the reel 202 and not pass through a lace hole 232*b*. In some embodiments, the second end 236*b* of the lace 206 can be secured to the article (e.g., a shoe) instead of to the reel 202.

In some embodiments, as the lace 206 is tightened, the reel 202 can incrementally lock against loosening of the lace 206 from tension on the lace 206. In some embodiments, the reel 202 can also provide for incrementally release of the lace 206, such that the lace 206 loosens by a predetermined amount when the user performs a loosening action but locks against further loosening until the user performs a subsequent loosening action. Thus, the reel 202 can allow for fine tuning of the tightness of the lacing system 200. When using a reel that provides a full release of the lace when a loosening action is performed, a user wishing to loosen the lace by a small amount (e.g., if the user accidentally tightened the lace too much) would fully release the lace and then retighten the lace, attempting this time to reach the desired tension. Because the user does not need to restart from a loosened position when using a reel with incremental release, it can be easier to reach the desired level of tension using an incremental release reel than using a full release reel. Incremental release of the lace can be particularly advantageous when the article is to be loosened during use. For example, in some sporting applications, an athlete may want an article to have a first level of tightness during a first mode of play and a lower level of tightness during a second mode of play. The incremental release can allow the athlete to reduce the tension on the lacing system during use without needing to fully release the lace.

The reel 202 can have features similar to, or the same as, the reel 100, including, but not limited to, the first and second engagement members 108, 110 and/or the drive member 114. In some embodiments, the reel 202 can include one or more pawls, and corresponding teeth to provide for incremental release of the lace 206. In the embodiment illustrated in FIGS. 4 and 5, housing 212 can have teeth 240 and the engagement member 216 can have one or more pawls 242 configured to engage the teeth 240 of the housing 212. The teeth 140 can extend radially inward from the inner surface of the side wall 222. The teeth 240 can line the periphery of the depression 224, and can extend substantially around the entire circumference of the depression 224. The pawls 242 can be coupled to the spool 214 such that the pawls 242 rotate with the spool 214. The pawls 242 can be integrally formed with the spool 214, permanently attached to the spool 214, or removably attachable to the spool 214.

In the embodiment illustrated in FIGS. 4 and 5, the engagement member 216 is removably attachable to the spool 214. The spool 214 can include one or more interface features 246 that are configured to engage corresponding interface features 248 on the engagement member 216. The interface features 246 on the spool can be protrusions that extend axially upward from the top surface of the spool 214, and the interface features 248 on the engagement member 216 can be corresponding recesses configured to receive the protrusions therein. The protrusions 246 and recesses 248 can be asymmetrical to prevent the engagement member 216 from being installed backwards or upside down. For example, as can be seen in FIG. 4, the spool 214 can have four protrusions positioned at or near the periphery of the spool 214, and one of the protrusions 246' can be smaller than the other protrusions 246 such that it is configured to fit into a recess 248' on the engagement member 216 that is smaller than the other recesses 248. Also, a protrusion 246" can have a shape that does not fit into the shape of the corresponding recess 248" if the engagement member 216 is positioned upside down. The engagement between the interface features 246, 246', 246", 248, 248', 248" can couple the engagement member 216 and the spool 214 so that they rotate together with respect to the housing 212.

Because engagement member 216 can be separately formed from the spool 214, the engagement member 216 and the spool 214 can be formed of different materials. For example, the spool 214 can be made from a glass filled nylon material so as to provide high stiffness, which can allow the spool 214 to be made of a small size while also providing a low level of deflection. In some embodiments, the engagement member 216 (including the pawls 242) can be made from a highly lubricious material, such as an acetal polyoxymethylene (POM) plastic, so as to reduce friction and wear as the pawls 242 deflect over the housing teeth 240. In some embodiments, a glass filled nylon material can accelerate wear on the housing teeth 240 if used to form the pawls 242. Various other materials can be used to form the spool and the engagement member. In embodiments in which the engagement member 216 is removably attached to the spool 214, the engagement member 216 can be replaced (e.g., if the pawls become worn out). In some embodiments, the engagement member 216 can engage and/or disengage from the spool 214 by sliding axially with the interface features 246, 248 aligned, so that the engagement member 216 can be removed from the spool 214 and replaced without removing the spool 214 from the housing 212. Also, because the pawls 242 are separately formed from the spool 214, the lace 206 can be contained within a channel on the spool 214 so that the lace does not contact the pawls 242.

Multiple pawls 242 can be used to distribute the load and to reduce the amount of wear that each pawl 242 experiences. For example, the use of additional pawls 242 can reduce the amount of load born by each individual pawl 242, thereby allowing each pawl 242 to be made more flexible (e.g., thinner), which can reduce the amount of force with which the pawls 242 deflect over the teeth 240 and can reduce the contact stress and rate of wear on the pawls 242 and/or on the housing teeth 240. As discussed above, wear on the pawls 242 can be accelerated when there is debris in the reel 202 (e.g., during certain sporting uses). During testing of "dirty" uses with debris present, a reel having four pawls could operate for more than twice as many rotations as a reel having three pawls before the reel would not hold tension. Thus, a 33% increase in the number of pawls provided a more than 100% increase in the useful life of the reel. The reel 202 can be used with any suitable number of pawls 242 (e.g., 1, 2, 3, 4, 6, 10, etc.)

Figure 9:
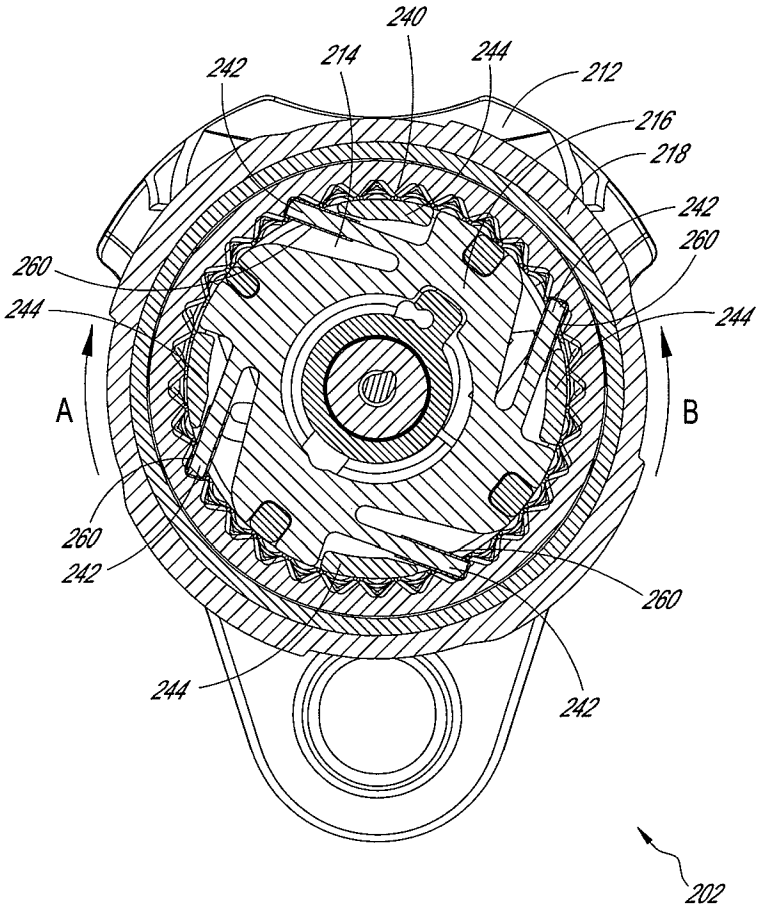
FIG. 9 is a cross sectional view of the reel of FIG. 4.
Figure 8:
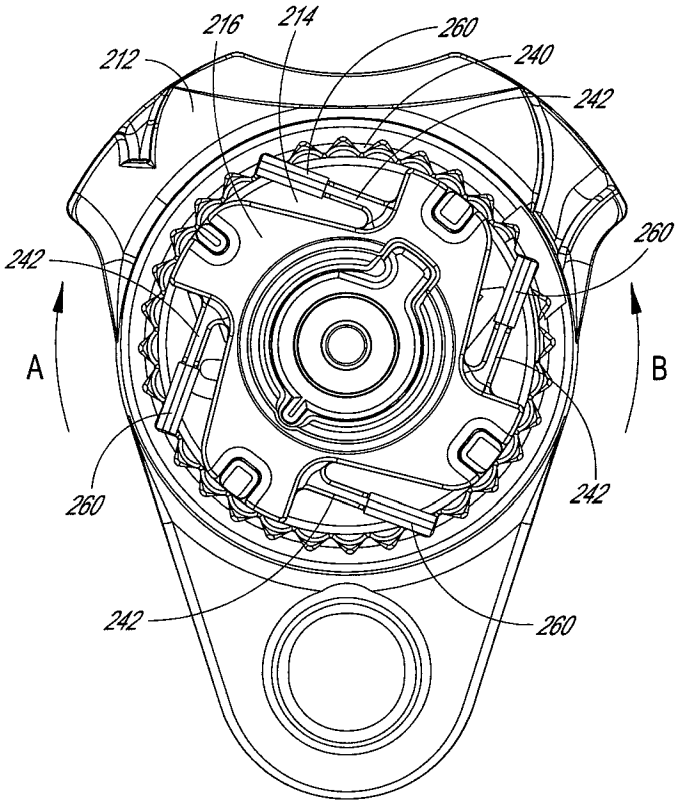
FIG. 8 is top view of the housing, spool and engagement member of the reel of FIG. 4.

The spool 214 and engagement member 216 can be placed into the depression 224 of the housing 212 so that the pawls 242 engage the teeth 240 as shown in FIG. 8. The pawls 242 can engage the teeth 240 so that the spool 214 can be rotated in a tightening direction (shown by arrow A) and so that the spool 214 is locked against rotation in the loosening direction (shown by arrow B). The reel 202 can include one or more drive members 244 that are configured to drive the spool 214. The drive members 244 can extend axially downward from the underside surface of the knob 218. FIG. 9 is a cross sectional view of the reel 202 taken along the plane where the pawls 242 engage the teeth 240. The drive members 244 can engage a drive surface 250 when rotated in the tightening direction A. The drive surface 250 can be part of the engagement member 216 (as shown in the illustrated embodiment), or of the spool 214, or any other portion that causes the spool 214 to rotate in the tightening direction A when the drive members 244 rotate in the tightening direction A. As can be seen in FIG. 9, the knob 218 is in the relaxed state, the drive members 244 can fit between the drive surfaces 250 and the pawls 242 with substantially no additional space therebetween, so that the knob 218 has substantially no play between driving the spool in the tightening direction A and displacing the pawls 242 (when the knob 218 is rotated in the loosening direction). In some embodiments, the drive members 244 can be configured to have a range of rotational movement between engaging the drive surfaces 250 on one side and engaging the pawls on the other side, so that the knob 218 has a range of play before it affects the spool 214 or pawls 242.

Figure 10A:
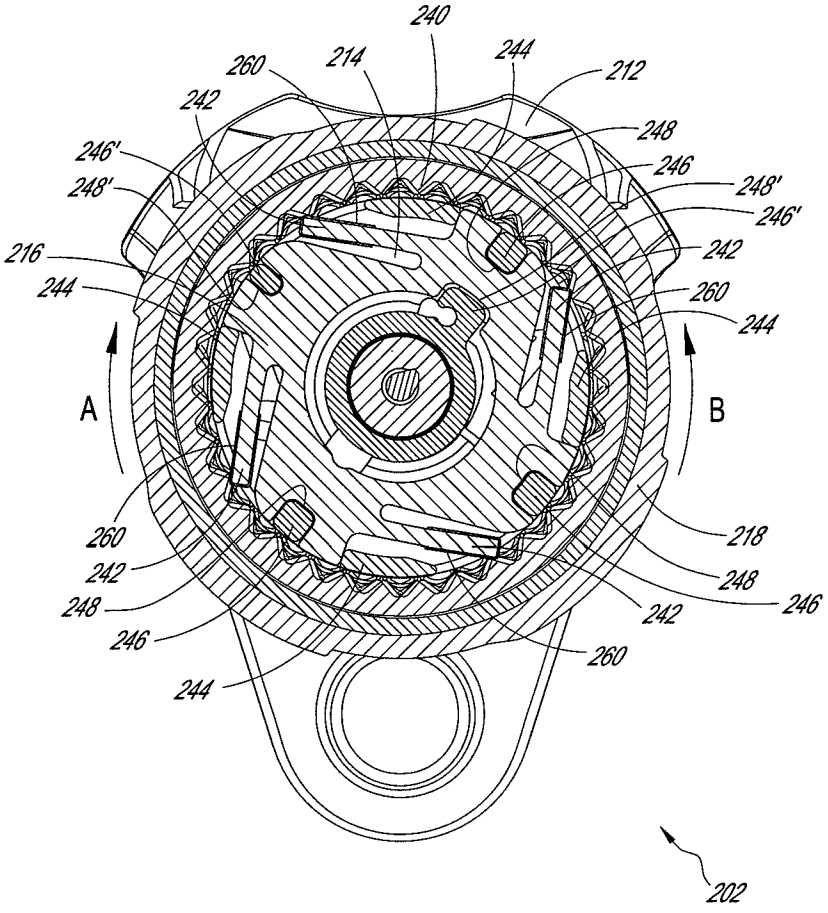
FIG. 10A is a cross sectional view of the reel of FIG. 4 being rotated in a tightening direction.
Figure 10B:
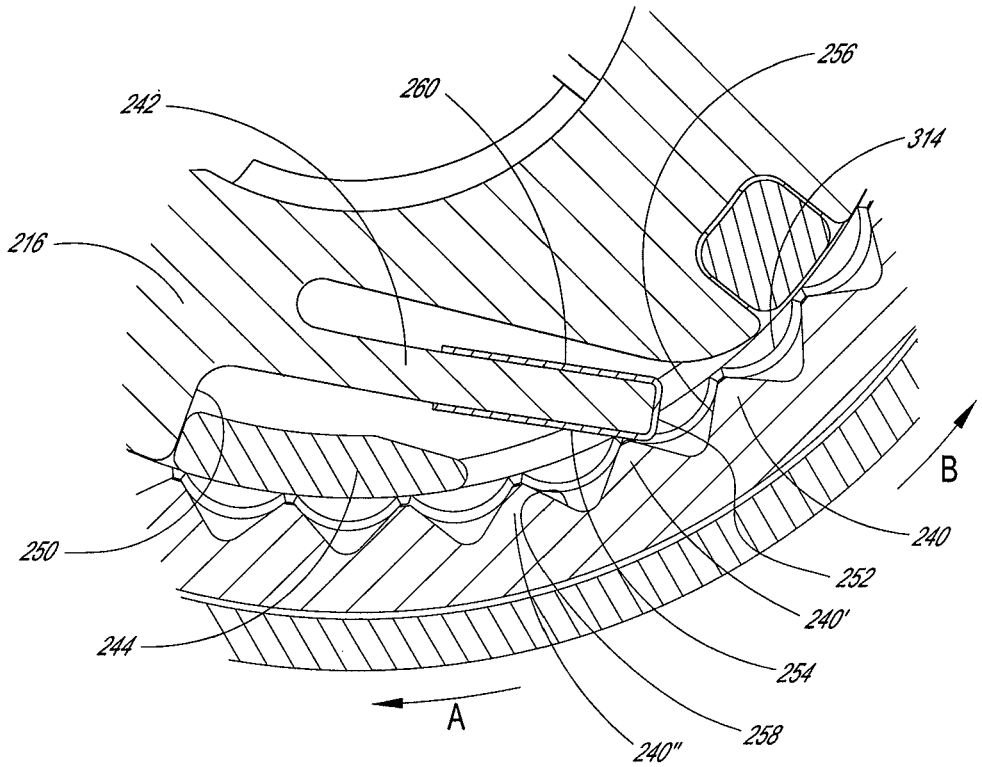
FIG. 10B is a detailed view of a portion of the cross sectional view of FIG. 10A.

FIG. 10A is a cross sectional view of the reel 202 as the spool 214 is rotated in the tightening direction A. FIG. 10B is a detailed view of a portion of the cross section of FIG. 10A. As the user rotates the knob 218 in the tightening direction A, the drive members 244 press against the drive surfaces 250 on the engagement member 216 causing the engagement member to rotate in the tightening direction A. Through the engagement of the interface features 246, 246', 246", 248, 248', 248", the rotation of the engagement member 216 causes the spool 214 to rotate in the tightening direction A. As the engagement member rotates in the tightening direction A, the end surfaces 252 of the pawls 242 can move away from the first surfaces 256 of the corresponding teeth 240, and the pawls 242 can flex radially inwardly, as shown in FIGS. 10A and 10B. When the engagement member 216 has rotated far enough in the tightening direction A to clear the tooth 240', the pawl 242 moves radially outward until the side surface 254 of the pawl 242 abuts against the second surface 258 of the adjacent tooth 240". Thus, as the engagement member 216 and spool 214 rotate in the tightening direction A, the pawls 242 ratchet along the teeth 240. Tension on the lace 206 can apply a force that urges the spool 214 to rotate in the loosening direction B. When the pawls 242 are in the engaged position with the teeth 240 (as shown in FIG. 9), tension on the lace 206 causes the end surfaces 252 of the pawls 242 to press against the first surfaces 256 of the corresponding teeth 240, thereby preventing the spool 214 and engagement member 216 from rotating in the loosening direction B. Because the pawls 242 ratchet along the teeth 240 during tightening, the spool 214 can be incrementally locked against being pulled in the loosening direction B by the tension on the lace 206.

Figure 11A:
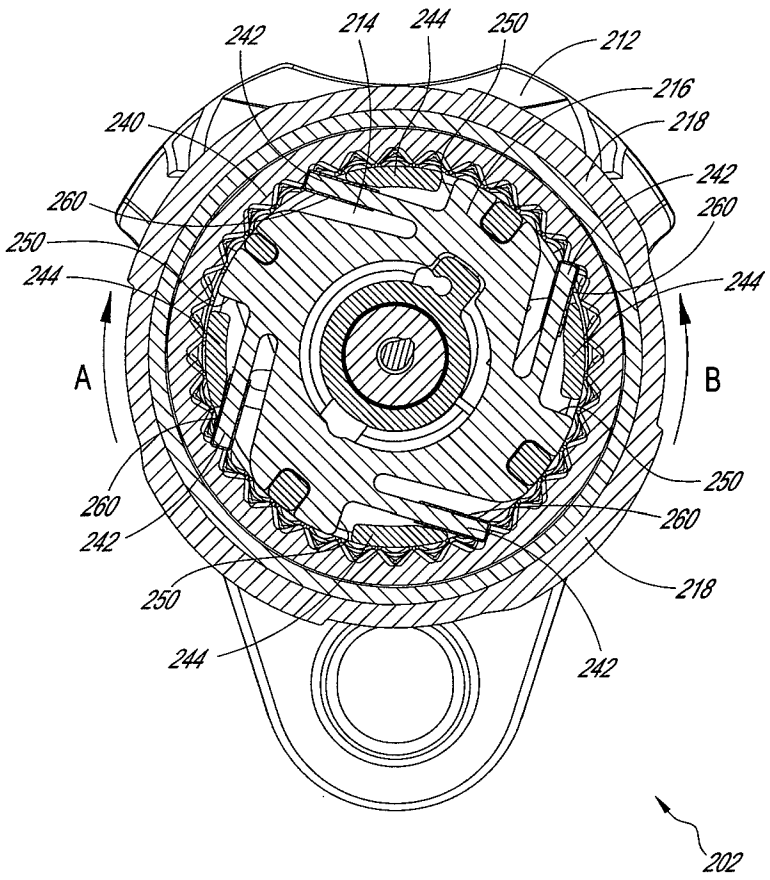
FIG. 11A is a cross sectional view of the reel of FIG. 4 being rotated in a loosening direction.
Figure 11B:
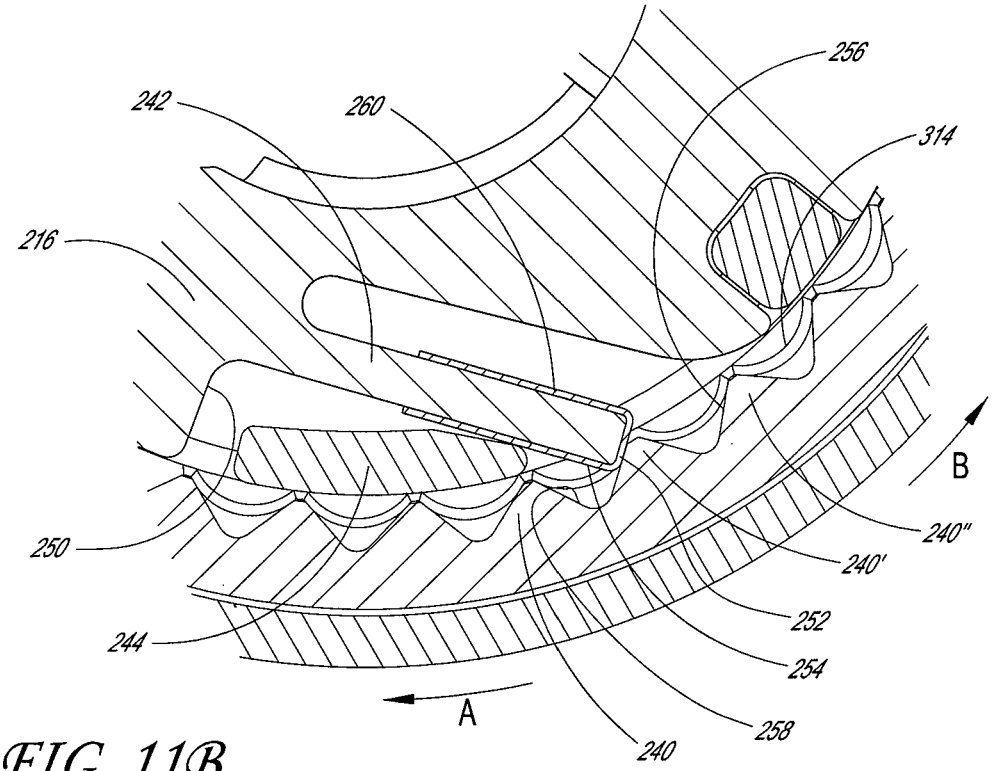
FIG. 11B is a detailed view of a portion of the cross sectional view of FIG. 11A.

FIG. 11A is a cross sectional view of the reel 202 as the spool 214 is rotated in the loosening direction B. FIG. 11B is a detailed view of a portion of the cross section of FIG. 11A. As the user rotates the knob 218 in the loosening direction B, the drive members 244 displace the pawls 242 radially inward away from the teeth 240. The drive members 244 advance in the loosening direction B, but the spool 214 and engagement member 216 do not advance in the loosening direction B. thus, the drive members 244 move away from the drive surfaces 250. The side surface 254 of the pawl 242 moves away from the second surface 258 of the tooth 240 until the pawl 242 clears the tooth 240'. Then the spool 214 and the engagement member 216 advance in the loosening direction B until the end surface 252 of the pawl 242 abuts against the first surface 256 of the tooth 240". If there is tension on the lace 206, the tension creates a force that pulls the spool 214 in the loosening direction B when the pawl 242 clears the tooth 240'. If there is no tension on the lace 206, the energy stored in the flexed pawl 242 creates a restoring force that causes the engagement member 216 to rotate in the loosening direction B to allow the pawl 242 to return to its unflexed state. When the pawl 242 clears the tooth 240', the spool 214 rotates in the loosening direction B by a distance corresponding to one tooth 240, and the pawl 242 then reengages the next tooth 240 to lock the spool 214 against further rotation in the loosening direction B. If the user continues to rotate the knob 218 in the loosening direction B, the spool 214 will incrementally loosen one tooth 240 at a time.

Additional details and features relating to lacing systems having incremental release are disclosed in U.S. Patent Publication No. 2010/0139057 (the "'057 Publication"), filed on Nov. 20, 2009, published on Jun. 10, 2010, and titled "REEL BASED LACING SYSTEM," the entirety of which is hereby incorporated by reference and made a part of this specification for all that it discloses. Many of the features and details disclosed in the '057 Publication can be incorporated into the reel 202 or any of the other embodiments disclosed herein.

In some embodiments, the repeated interfacing between the pawls 242 and the teeth 240 can cause the pawls 242 and/or the teeth 240 to wear down during use. In some cases, the wear can shorten the useful life of the reel 202, or it can cause the reel 202 to fail. Unexpected failure of the reel 200 can result in undesired and even sudden loss of tension in the lacing system, which can compromise an athlete's performance. In some embodiments, a reel 202 that provides for incremental release of the lace 206 can be subject to additional wear on the pawls 242 and/or teeth 240 because of the repeated disengagement and reengagement during both tightening and loosening. Also, in some applications, especially during sports, debris can enter the reel 202 (e.g., through the lace hole 232*a*). The debris can be abrasive and can accelerate the rate of wear. In some embodiments, the pawls 242 can be formed of a material that is generally rigid but flexible enough that the pawls 242 can deform away from the corresponding teeth 240, which may require the use of a material having reduced durability. Additional, the reel may include more teeth 240 than pawls 242, so that each pawl 242 experiences wear with every increment of tightening or loosening while each tooth 240 only experiences wear when it is individual engaged. For these reasons, in some embodiments, the pawls 242 can wear out faster than the teeth 240.

Figure 12:
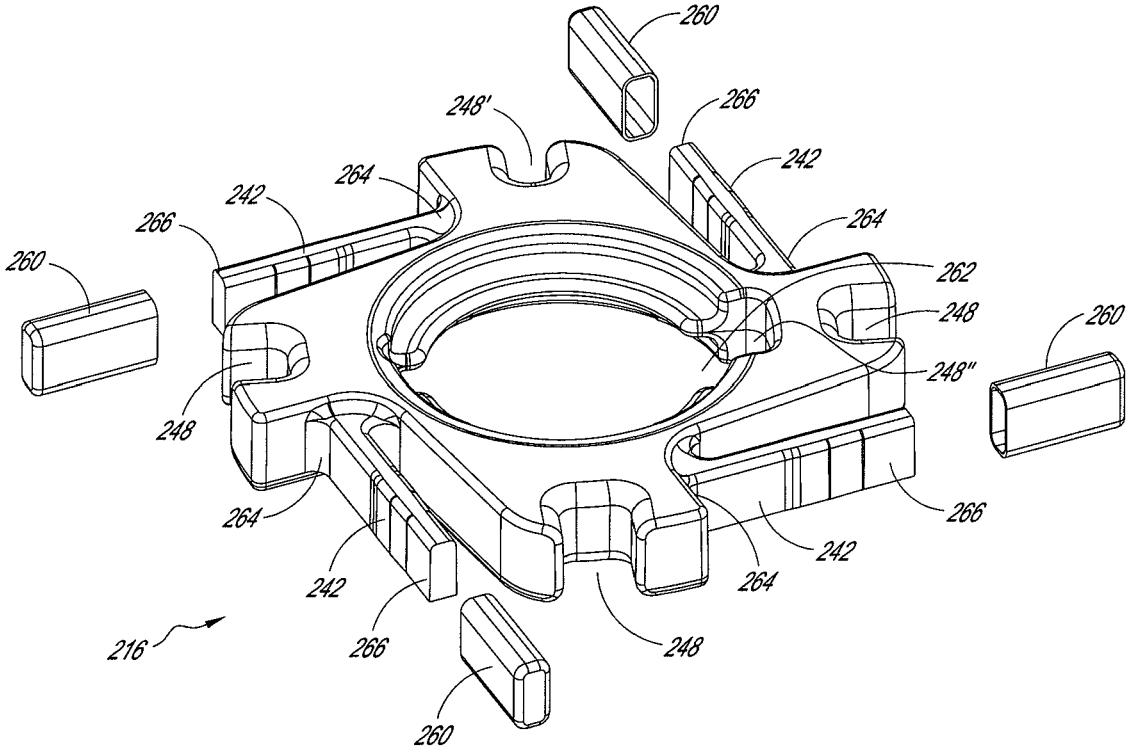
FIG. 12 is an exploded perspective view of the engagement member of the reel of FIG. 4 with caps.

In some embodiments, caps 260 can be positioned on the ends of the pawls 242 to increase the durability of the pawls 242. FIG. 12 is an exploded perspective view of the engagement member 216 and the caps 260. The caps 260 can be made of brass, stainless steel, or any other suitably durable material. The caps 260 can cover the portions of the pawls 242 that contact the teeth 240. The caps 260 can extend back along the pawls 242 so that they also cover the portions of the pawls 242 that contact the drive members 244. In the illustrated embodiment, the caps 260 have side walls that form a hollow generally rectangular cylindrical shape, a closed end at one side, and an open end at the other side for receiving the end of the corresponding pawl 242 into the hollow center of the cap 260. Other configurations are possible. For example, the protection elements can be plates formed on the radially outward-facing side 254 of the pawls 242 and/or on the end surface 252 of the pawls 242. In some embodiments, the teeth 240 can be covered with a protective element, such as metal plates. During testing, a reel using brass caps could operate for more than three times as many revolutions as a reel with no caps before the reel would not hold tension, and a reel using stainless steel caps could operate for about ten times as many revolutions as a reel with no caps before the reel would not hold tension. In some embodiments, the caps 260 can have a lubricious coating to reduce friction and wear on the housing teeth 240. Because the caps 260 can cover the portions of the pawls 242 that contact the housing teeth 240, the pawls 242 can be formed from materials (e.g., glass filled nylon) that would increase wear on the housing teeth 240 if the pawls 242 directly contacted the teeth 240. For example, the pawls 242 can include caps 260, and the pawls 242 can be integrally formed with the spool 216 and made of a material of high stiffness (e.g., of glass filled nylon).

As can be seen in FIG. 12, the engagement member 216 can be generally flat and can include a central opening 262 that can receive a portion of the spool 214 and/or the shaft 226 to center the engagement member 216 around the axis 230 (see FIG. 4). Each of the pawls 242 can have an arm that has an attached end that is coupled to the body of the engagement member 216 and an unrestrained end that can move generally radially inward and/or outward as the arm of the pawl 242 flexes. The arm of the pawl 242 can be formed thin enough so that it can flex during tightening and loosening, as described herein.

Figure 13:
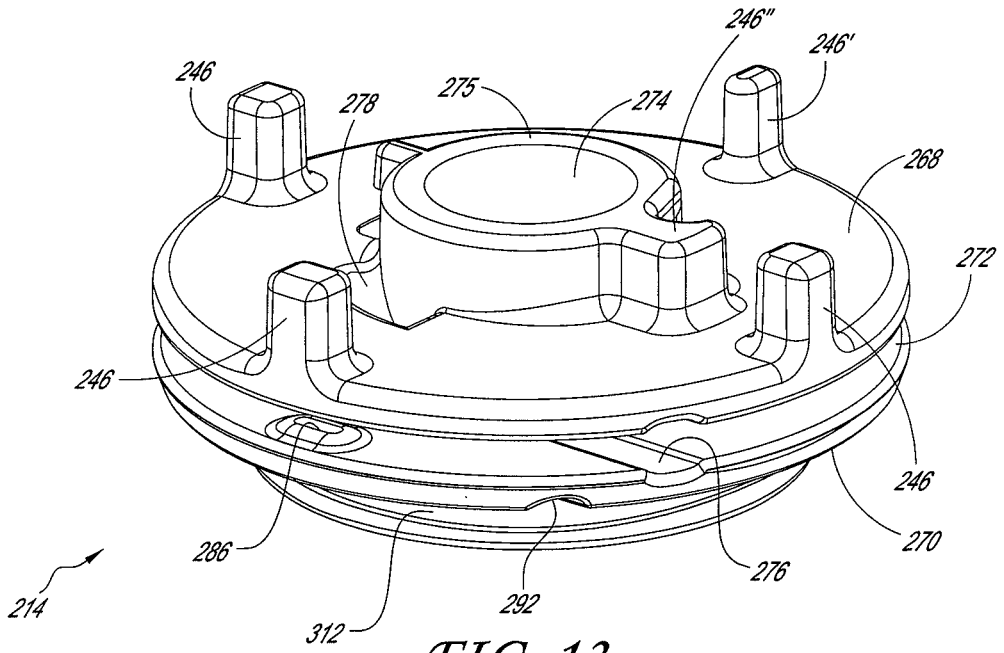
FIG. 13 is a top perspective view of the spool of the reel of FIG. 4.
Figure 14:
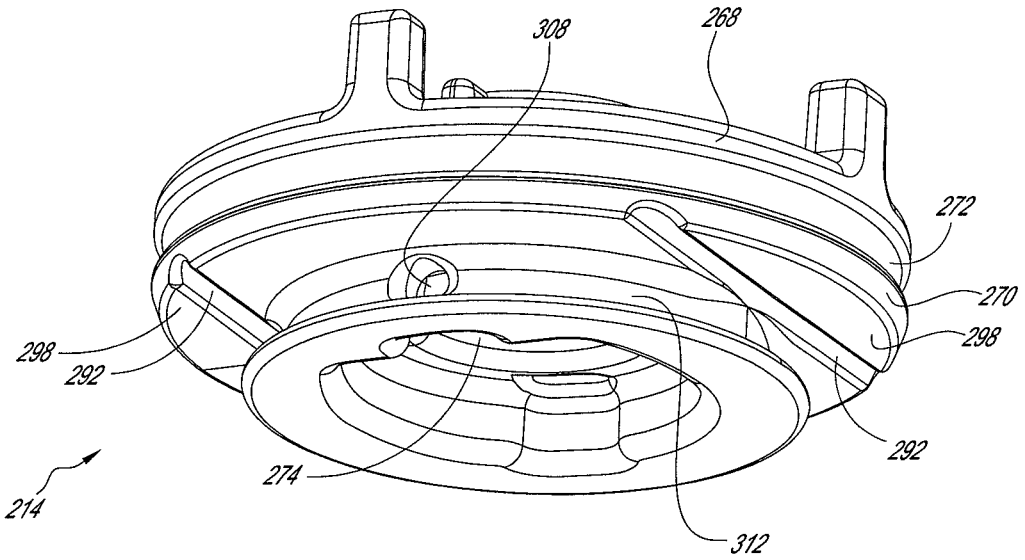
FIG. 14 is a bottom perspective view of the spool of the reel of FIG. 4.
Figure 15:
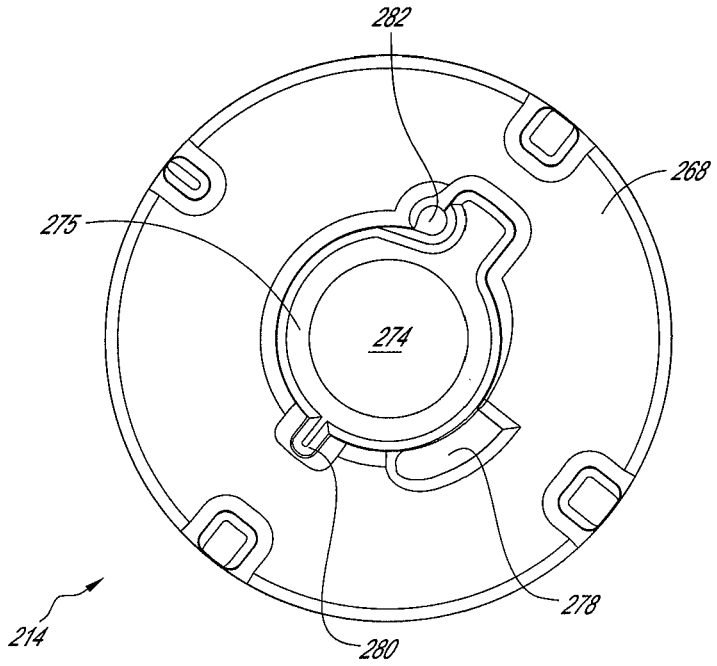
FIG. 15 is a top view of the spool of the reel of FIG. 4.
Figure 16:
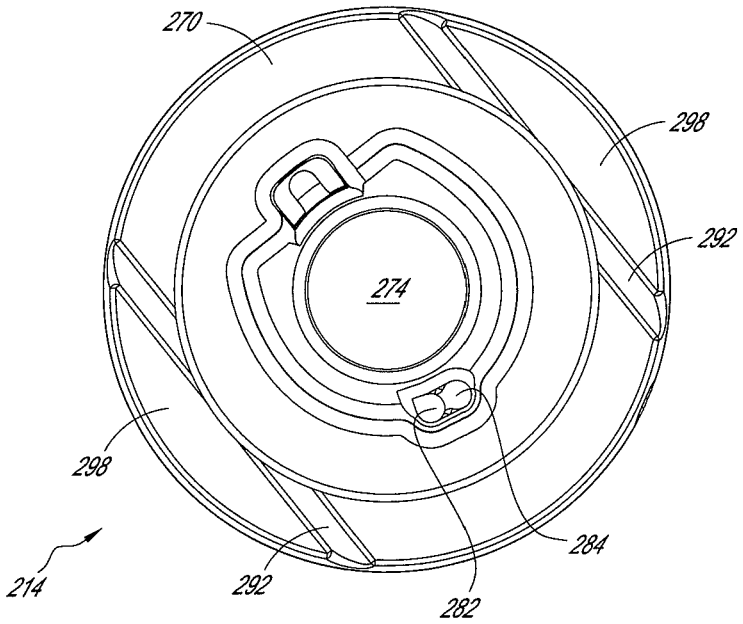
FIG. 16 is a bottom view of the spool of the reel of FIG. 4.

FIG. 13 is a top perspective view of the spool 214. FIG. 14 is a bottom perspective view of the spool 214. FIG. 15 is a top view of the spool 214, and FIG. 16 is a bottom view of the spool 214. The spool 214 can have a top disc 268, a bottom disc 270, and a channel 272 formed therebetween. When the spool 214 is rotated in the tightening direction A, the spool 214 can wind the lace 206 around the channel 272 thereby gathering the lace 206 into the reel 202. A central opening 274 can extend through the spool 214 and can receive the shaft 226 therein when the reel 202 is assembled. A raised wall 275 can extend upward from a central portion of the top disc 268 generally surrounding the central opening 274. As discussed in connection with FIG. 6, the first end 236*a* of the lace 206 can be secured to the spool 214. The first end 236*a* of the lace 206 can be tied to a portion of the spool 214, adhered to the spool 214, attached to the spool 214 using a clip, compressed ferrule, or a knot or in any other suitable manner. In the illustrated embodiment, the lace 206 can be secured to the spool 214 using a friction fitting. The spool 214 can include a groove 276 formed in the channel 272 that can lead to a hole 278 in the top disc 268 that allows the lace 206 to exit the channel 272. With reference to FIG. 15, the lace 206 can extend from the hole 278 clockwise around the raised wall 275, passing under a protrusion 280, to a hole 282 that is on a generally opposite side of the spool 216 as the hole 178. The lace 206 can pass down through at least a portion of the spool 216 via the hole 282, and the lace 206 can then turn to extend generally upward through a hold 284 that is adjacent to the hole 282. The friction placed on the lace 206 as it passes through the hole 278, around the cylindrical wall portion 275, down the hole 282, and up the hole 284 can secure the lace 206 to the spool 214 under normal loads.

Figure 17:
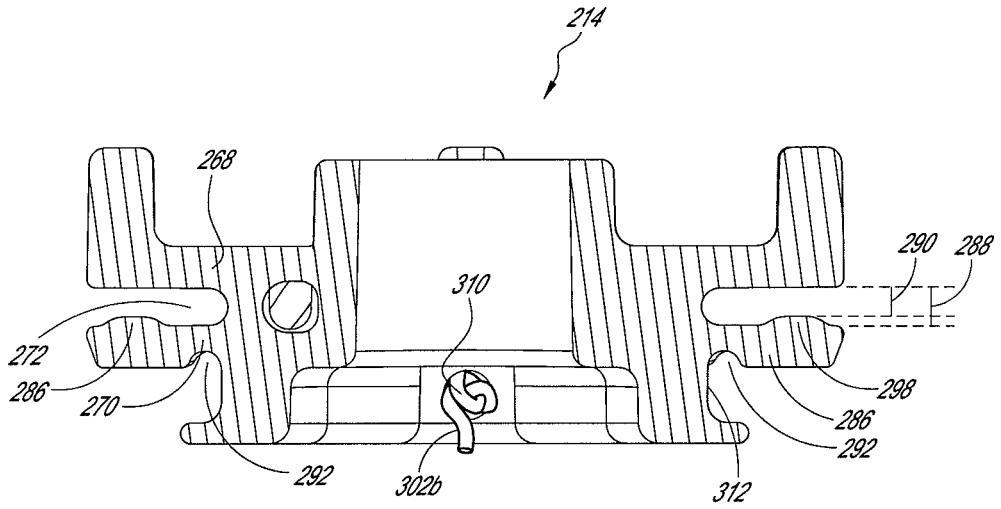
FIG. 17 is a cross sectional view of the spool of the reel of FIG. 4.

In some embodiments, the reel 200 can include a lace retaining element that is configured to retain the lace 206 radially inward away from the inner walls of the housing 212 during loosening. One or more detents 286 can be formed on the inside surface of the top disc 268 or bottom disc 270, forming a narrowed region in the channel 272. FIG. 17 is a cross sectional view of the spool 214. The channel 272 can have a general width 288 that is larger than the thickness of the lace 206. The narrowed region created by the detents 286 can have a width 290 that is less than the thickness of the lace 206. For example, the detents 286 can have a height of at least about 0.25 mm and/or less than or equal to about 0.75 mm, and can have a height of about 0.5 mm. The narrowed region created by the detents 286 can engage the lace 206 and retain the lace radially inward away from the walls of the housing 212.

Figure 19:
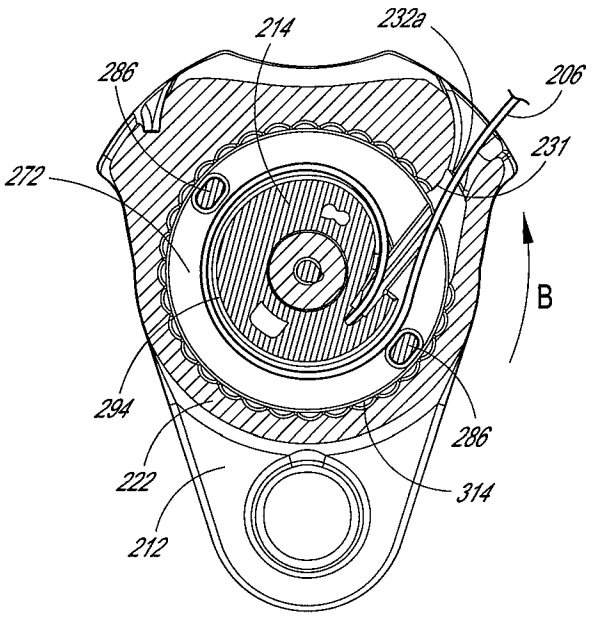

FIGS. 19, 20, and 21A-B are cross sectional views of the reel 202 that illustrate how the detents 286 retain the lace 206 radially inward during loosening. When tension is on the lace 206, the lace 206 can be pulled tight until it abuts against the radially inner surface 294 of the channel 272. If the lace 206 is loosened when there is little or no tension on the lace 206, the lace 206 can tend to back up inside the reel. For example, as the spool loosens, the lace 206 can start to unwind inside the reel 202, moving radially outward away from the radially inner surface 294 of the channel 272. If the lace 206 is permitted to abut against the radially inwardly facing wall of the housing 212, the friction between the lace 206 and the housing 212 can cause the lace 206 to double back on itself as the spool 214 loosens. In the illustrated embodiment, as the spool 214 rotates in the loosening direction B, the lace 206 can move radially outward until it reaches the narrowed region formed by the detent 286, as shown in FIG. 19. The detent 286 can engage the lace 206 and prevent the lace 206 from moving radially outward to the housing wall 222, thereby facilitating the movement of the lace 206 out of the reel 202 via the opening 232*a*. In some embodiments, a portion of the lace 206 can contact the wall 222 of the housing 212 at positions between the detents 286 as the spool 214 is loosened, but the detents 286 can reduce the amount of the lace 206 that contacts the wall 222 so that the friction between the lace 206 and wall 222 does not cause the lace 206 to double back inside the reel 202 in normal use. In some embodiments, the detents 286 can be configured to prevent any of the lace 206 from contacting the wall 222 of the housing 212 as the lace 206 is loosened.

As the spool 214 continues to rotate in the loosening direction B (e.g., from the position of FIG. 19 to the position of FIG. 20), the lace 206 and the detent 286 can rotate together toward the opening 232*a*. Preferably, the lace 206 does not slide against the detent 286 as the lace 206 and detent 286 advance toward the opening 232*a*, so the detent 286 does not apply friction to the lace 206 that can cause the lace to double back inside the reel 202. In some embodiments, the detent 286 can push the lace 206 toward the opening 232*a* as the detent 286 rotates toward the opening 232*a* (e.g., from the position of FIG. 19 to the position of FIG. 20).

Figure 20:
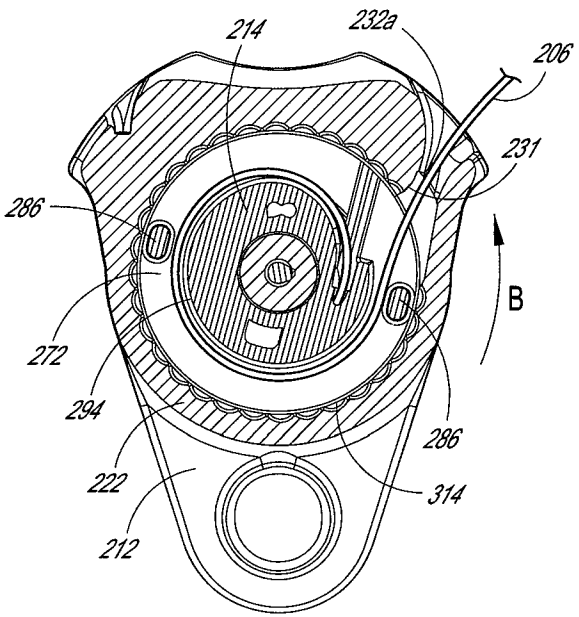
FIGS. 19-21B are cross sectional views of the reel of FIG. 4 that illustrate an example embodiment of loosening of the lacing system.
Figure 21B:
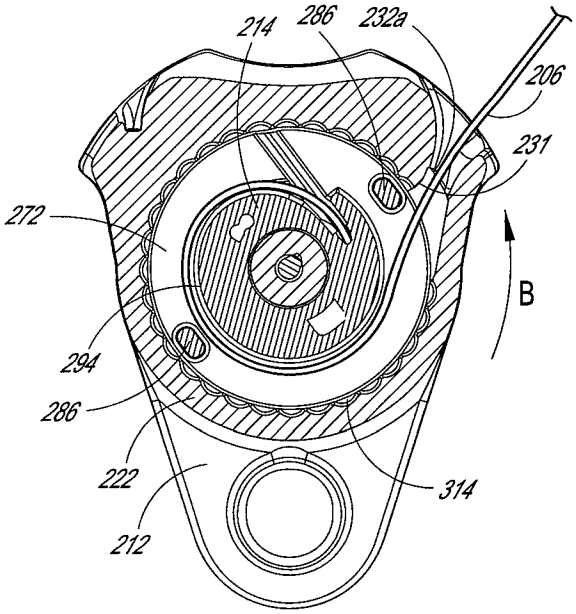

As the spool 214 continues to rotate in the loosening direction B, the detent 286 passes from one side of the lace (shown in FIG. 20) to the other side of the lace (shown in FIG. 21B). Because the narrowed region of the channel 272 that is formed by the detents 286 has a width 290 that is less than the thickness of the lace 206, the detent 286 can tend to pinch the lace 206 and cause the lace 206 to double back as the spool 214 moves from the position of FIG. 20 toward the position of FIG. 21B. To allow the lace 206 to cross over the detent 286, the narrow region of the channel 272 can be configured to widen. For example, the detent 286 can be configured to displace to a widened configuration. The spool 214 can have one or more grooves 292 formed on the same disc as the detent 286 (the bottom disc 270 in the illustrated embodiment), and the grooves 292 can provide a pivot area that can allow the bottom disc 270 to flex from a relaxed position (shown in FIG. 17) to a flexed position (shown in FIG. 18). In the flexed position, the narrow region created by the detent 286 has a width 296 that is large enough for the lace 206 to pass through. Thus, the bottom disc 270 can have one or more wing portions 298 that correspond to the one or more detents 286 and that are configured to bend away from top disc 268 as the lace 206 passes over the detents. The wing portions 298 can flex so as to rotate about the pivot area by an angle θ of at least about 2° and/or less than or equal to 10°, or of at least about 5° and/or less than or equal to about 7°, although other angles can be used.

Figure 18:
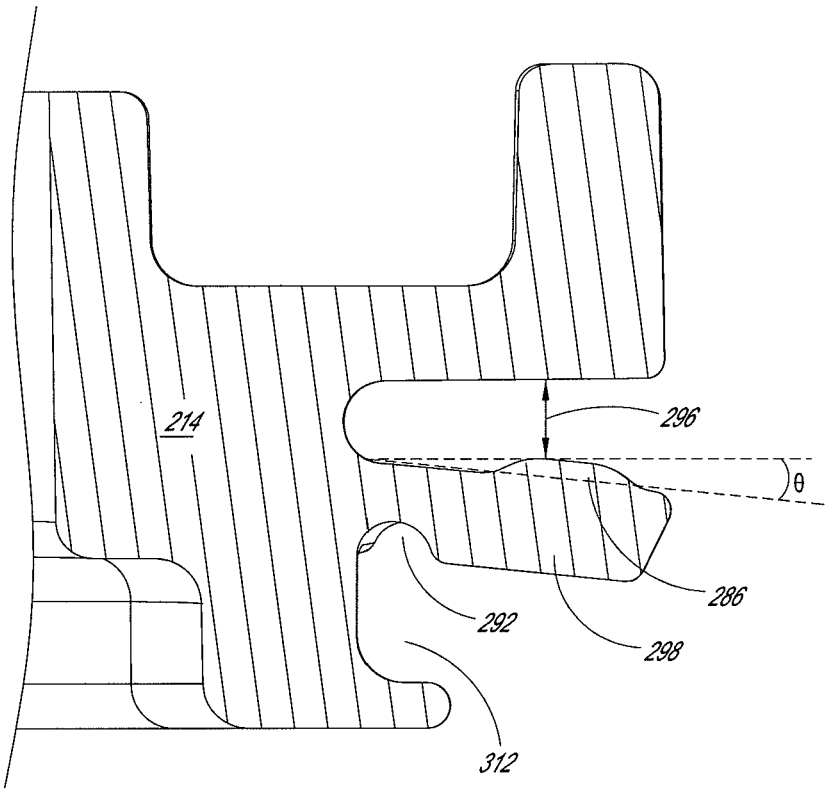
FIG. 18 is a detailed view of a portion of the cross sectional view of FIG. 17 in which the detent is in a deflected position.
Figure 21A:
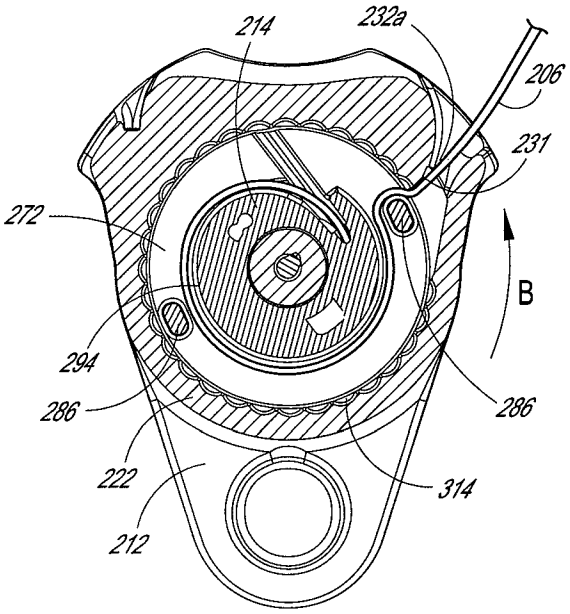

As shown in FIG. 21A, as the detent 286 rotates past the opening 232*a*, the detent 286 can press the lace 206 against a side wall 231 of the opening. The friction of the lace 206 against the side wall 231 can cause the narrow region formed by the detent 286 to widen as the detent 286 rotates further in the loosening direction B (e.g., by causing the lace 206 to press the detent 286 downward). Once the narrow region is widened enough (e.g., as shown in FIG. 18), the lace 206 passes across the detent 286 and the narrow region returns to the relaxed position (shown in FIG. 17). The height of the detent 286 and the flexibility provided by the groove 292 can be configured so that the housing opening 232*a* can engage the lace 206 to peel the lace 206 off the detent 286 as the detent 286 rotates past the opening 232*a*.

Many variations are possible. For example, the channel 272 can include any suitable number of detents 286 (e.g., 1, 2, 3, 4, 5 detents, etc.) In some embodiments, detents 286 can be formed on both the top disc 268 and the bottom disc 270. In some embodiments, a portion of the disc opposite the detents 286 can be configured to flex outward to allow the lace to cross the detent. For example, the grooves 292 and detents 286 can be formed on opposite discs 268, 270. In some embodiments, the detents 286 can be movable in corresponding bores and can be coupled to springs that bias the detents 286 into the channel 272, and the springs can be compressed to allow the detents 286 to withdraw into the bores to widen the channel 272 at the location of the detents 286 as the lace 206 crosses.

In some embodiments, the reel 202 can have a rotation limiter to prevent the spool 214 from being rotated in the loosening direction B past the fully loose position, which can draw lace 206 into the reel 202 without locking against loosening, and/or to prevent the spool 214 from being rotated too far in the tightening direction A, which can jam the reel 202. The rotation limiter can include a stop cord 300. With reference to FIGS. 6 and 7, a first end 302*a* of the stop cord 300 can be secured to the housing 212. The first end 302*a* of the stop cord 300 can extend from the depression 224 of the housing 212 through a hole 304 formed, for example, in the bottom surface of the depression 324, and a knot 306 can prevent the first end 302*a* of the stop cord 300 from retracting back into the depression 224. The second end 302*b* of the stop cord 300 can be secured to the spool 214. For example, with reference to FIGS. 14 and 17, the second end 302*b* of the stop cord 300 can pass through a hole 308 formed in the spool 214 and a knot 310 can prevent the second end 302*b* from retracting through the hole 308. The ends 302*a*, 302*b* of the stop cord 300 can alternatively be secured to the housing 212 and spool 214 using an adhesive, a clip, a friction fitting, or in any other suitable manner.

Figure 23:
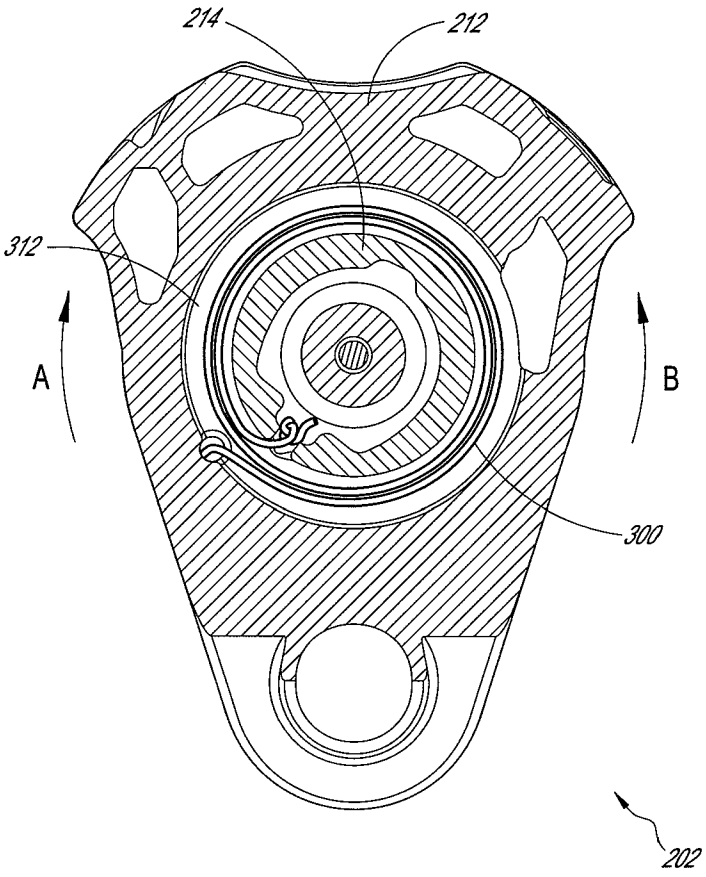
FIG. 23 is a cross sectional view of the reel of FIG. 4 in a fully loose position.
Figure 22:
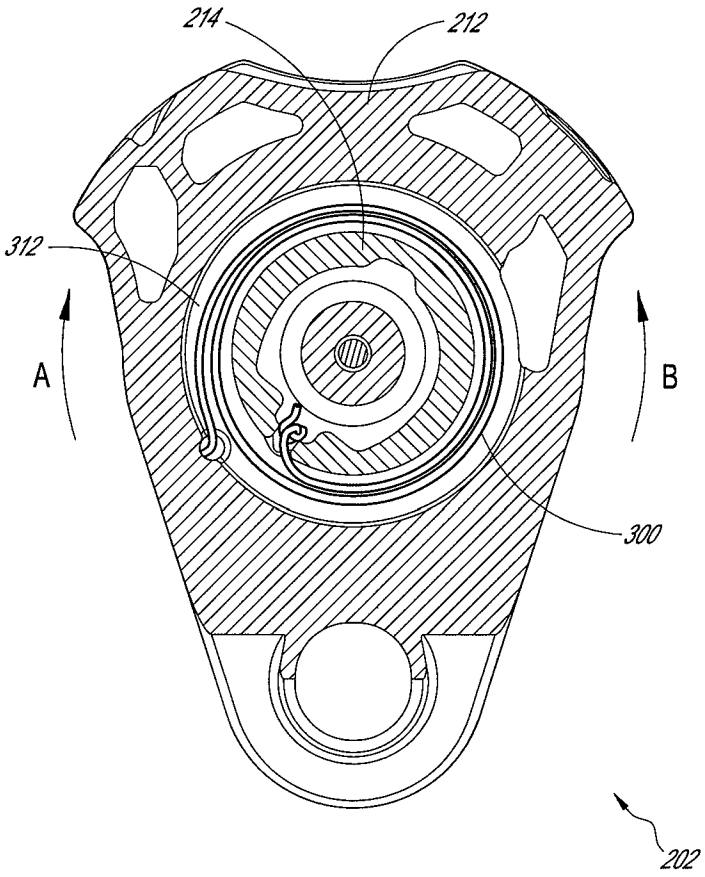
FIG. 22 is a cross sectional view of the reel of FIG. 4 in a fully tight position.
Figure 24:
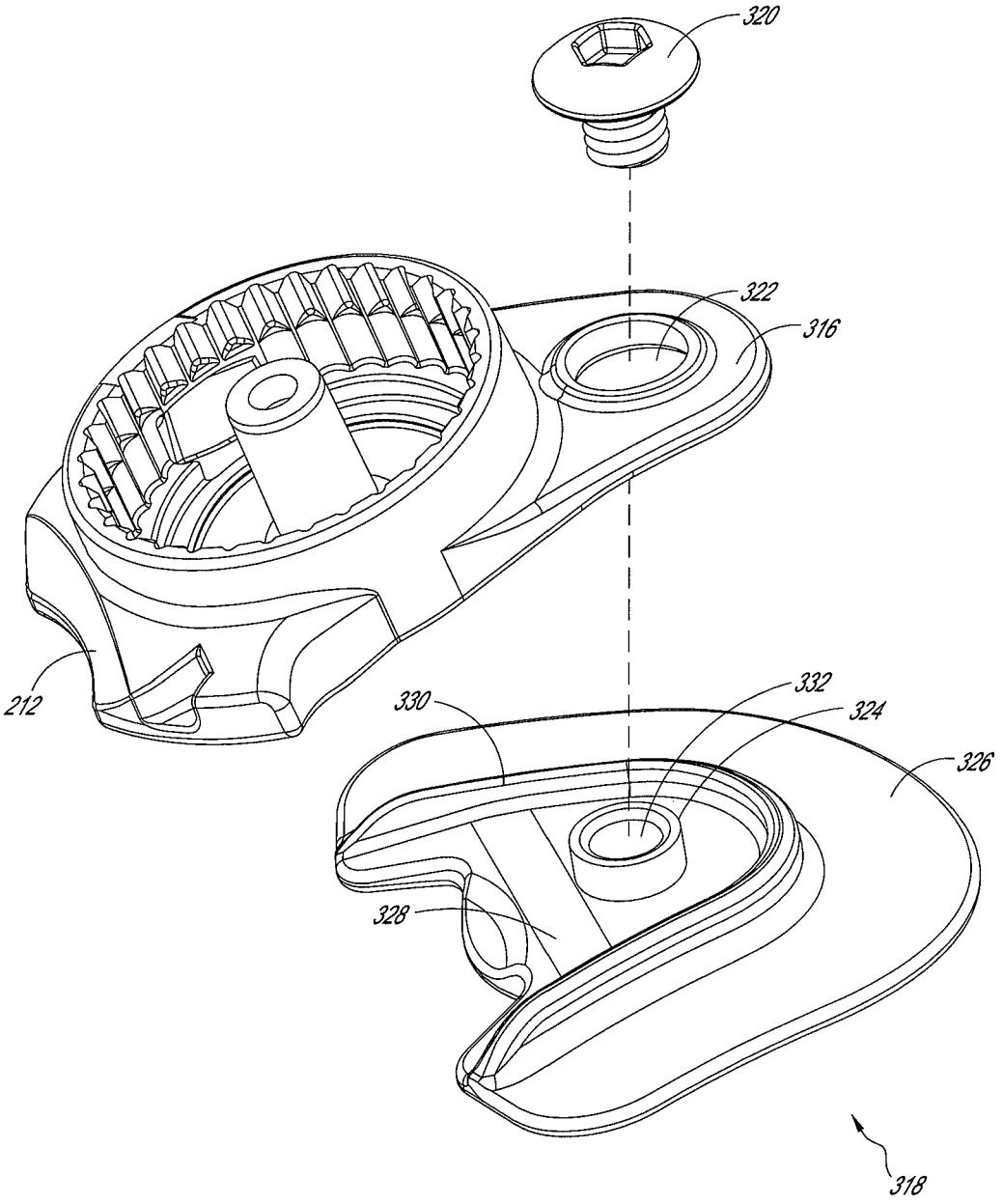
FIG. 24 is an exploded perspective view of the housing and a mounting base.
Figure 25:
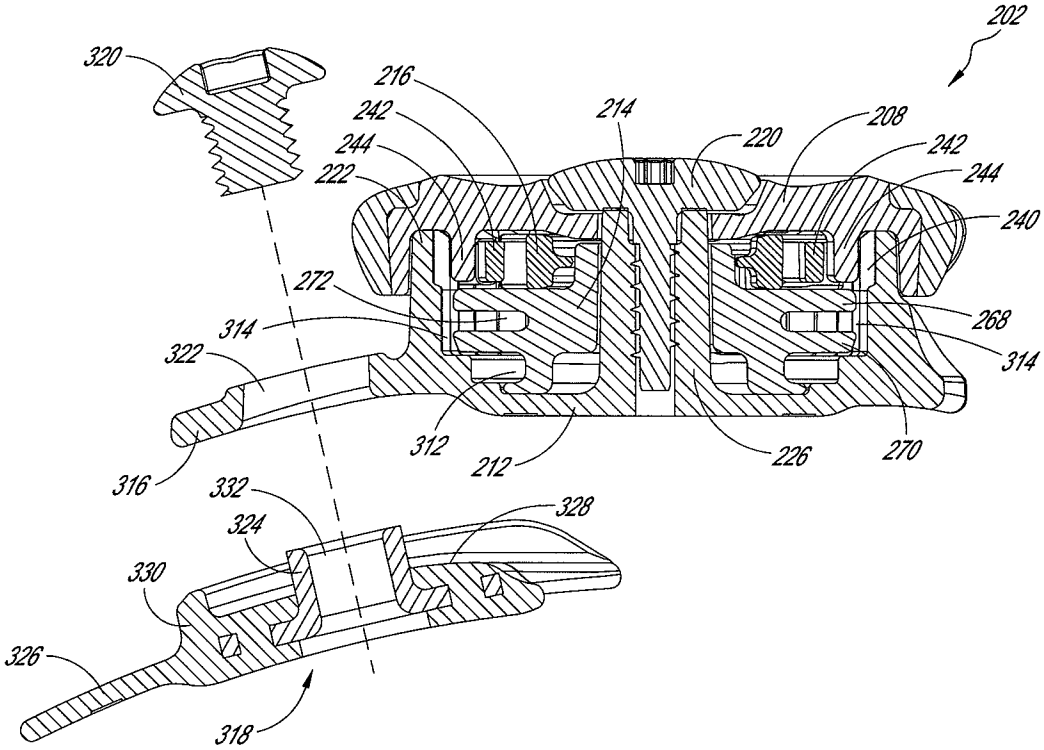
FIG. 25 is an exploded cross sectional view of the reel of FIG. 4 and the mounting base of FIG. 24.

The spool 214 can have a stop cord channel 312 that is configured to receive the stop cord 300 as the spool 214 rotates. In some embodiments, the stop cord 300 can wind around the shaft 226 or any other suitable feature of the reel 202. FIGS. 22 and 23 are a cross sectional views of the reel 202 taken through the stop cord channel 312. In FIG. 22, the spool 214 is in a fully tightened position, having the stop cord 300 wound around the stop cord channel 312 such that the stop cord 300 prevents the spool 214 from rotating further in the tightening direction A. In FIG. 23, the spool 214 is in a fully loosened position, having the stop cord 300 wound around the stop cord channel 312 such that the stop cord 300 prevents the spool 214 from rotating further in the loosening direction B. Although the stop cord 300 in FIGS. 22 and 23 is shown somewhat loose for illustrative purposes, the stop cord 300 can be tightly wound against the stop cord channel 312 when in the fully tightened or fully loosened positions. Additional details and features relating to the stop cord 300 are disclosed in the '057 Publication and can be incorporated into the reel 202 or any other embodiment disclosed herein.

The stop cord 300 can be made of any of a variety of materials including steel, monofilament, nylon, Kevlar, or any other suitable material. In some embodiments, SPECTRA™ fiber (manufactured by Honeywell of Morris Township, N.J.) can be used to form the stop cord 300. In some embodiments, the stop cord 300 can be similar to, or the same as, the lace 206 in construction or size or other regards. In some embodiments, the stop cord 300 can have a different size than the lace 206. For example, the stop cord can have a diameter of at least about 0.01 inches and/or no more than about 0.03 inches. In some embodiments, the stop cord can have a diameter outside the ranges provided.

Referring now to FIG. 4, the reel 202 can include a debris diverter. For example, notches 314 can be formed in the housing 212, such as on the radially inwardly facing surface of the wall 222. The notches 314 can be positioned below the teeth 240, and the notches can be shaped and positioned such that the radial size of one notch 314 corresponds to the radial size of one tooth 240. The notches 314 can be semicircular in shape, or they can be angled, or they can have any other suitable shape. In some embodiments, the teeth 240 can extend downward below the area where the pawls 242 engage the teeth 240 to form the notches 314 between the teeth 240. The notches 314 can extend substantially around the entire circumference of the wall 222 except for at the opening 234. The notches 314 can be positioned such that the discs 268, 270 and the channel 272 of the spool 214 substantially align axially with the notches 314, as can be seen in FIGS. 19-21. Thus, debris that enters the channel 272, or other internal portions of the reel 202, can be directed radially outward by the rotation of the spool 214. The debris can then be directed into the space provided by the notches 314, thereby reducing the likelihood that the debris will lodge between the spool 214 and the housing 212 and jam the reel 202. As can be seen in FIGS. 10B and 11B, the area inside the reel 202 where the pawls 242 interface with the teeth 240 can be exposed to the notches 314 and positioned above the notches 314. Thus, if debris enters the area where the pawls 242 interface with the teeth 240, gravity can direct the debris down into the notches 314 thereby reducing abrasion on the pawls 242 and teeth 240. The engagement and disengagement of the pawls 242 and teeth 240 can dislodge debris that is deposited in this interface area, thereby assisting in directing the debris into the notches 314.

Figure 26:
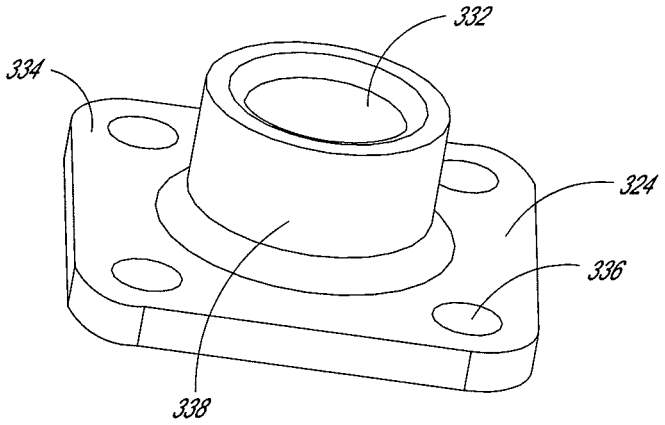
FIG. 26 is a perspective view of a bore insert.
Figure 27:
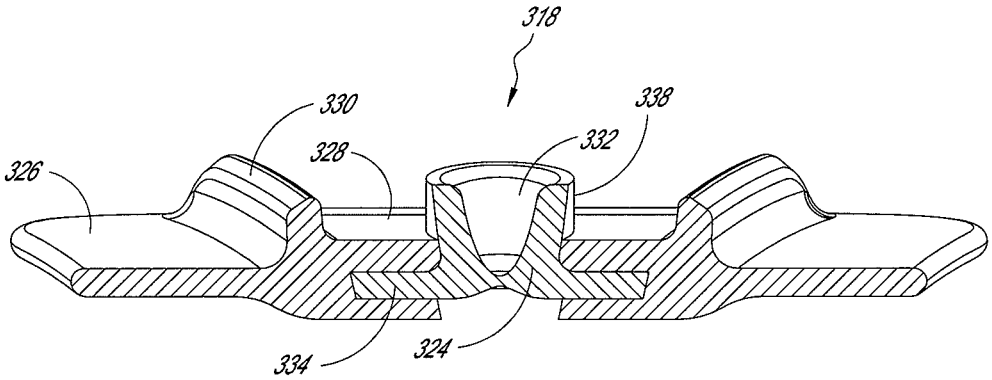
FIG. 27 is a cross sectional view of the mounting base incorporating the bore insert of FIG. 26.

The reel 202 can be attached to an article (e.g., the shoe 208) in various manners. The reel 202 can include a mounting flange 316, which can be formed as part of the housing 212. In come embodiments, the mounting flange 316 can be sewn, adhered, bolted, or otherwise coupled directly to the shoe 208. With reference now to FIGS. 24-27, in some embodiments, the reel 202 can be releasably mounted onto the shoe 208 or other article. For example, a mounting base 318 can be sewn, adhered, bolted, or otherwise attached to the article (e.g., to the side, heel, or tongue of the shoe 208). In some embodiments, the mounting base 318 can include a securing flange 326 that can be sewn to the side of a shoe 208. The mounting flange 316 can be configured to fit into a slot 328 on the mounting base 318, which can be formed or surrounded by a wall 330. A bolt 320 can pass through a hole 322 in the mounting flange 316 and can engage with a bore on the mounting base 318. In some embodiments, the bore 332 can be formed as part of a bore insert 324. FIG. 26 is a perspective view of the bore insert 324, which can include a tab 334 and side walls 338 forming a bore 332. In some embodiments, the tab 334 can be generally square shaped and can have one or more holes 336 (e.g., formed near each of the four corners), which can be configured to be filled with material as the rest of the mounting base 318 is overmolded around the bore insert 324, thereby increasing the strength of the interface between the mounting base 318 and the bore insert 324. Other shapes and configurations are possible. FIG. 27 is a cross sectional view of the mounting base 318 having the bore insert 324. The tab 334 can secure the bore insert 324 to the surrounding material (e.g., of the slot 328, and the bore 332 can be exposed so that it can receive the bolt 320 for securing the reel 202 to the mounting base 318.

Although disclosed in the context of certain preferred embodiments and examples, it will be understood by those skilled in the art that the present disclosure extends beyond the specifically disclosed embodiments to other alternative embodiments and/or uses and obvious modifications and equivalents thereof. In addition, while a number of variations have been shown and described in detail, other modifications, which are within the scope of this disclosure, will be readily apparent to those of skill in the art based upon this disclosure. It is also contemplated that various combinations or subcombinations of the specific features and aspects of the embodiments can be made and still fall within the scope of the disclosure. Accordingly, it should be understood that various features and aspects of the disclosed embodiments can be combined with or substituted for one another. Thus, it is intended that the scope of the disclosure should not be limited by the particular disclosed embodiments described above.

What is claimed is:

1. A reel for use in a lacing system, the reel comprising:

a housing having an interior region;

a spool rotatably positioned within the interior region of the housing, the spool having an upper disc and a lower disc with a channel defined there between, the spool being rotatable within the interior region in a first direction to wind a tension member about the channel and being rotatable in a second direction to unwind the tension member from about the channel;

a pawl component that is separate from the spool and that is removably attachable to the spool so that the pawl component is rotatable with the spool in the first direction, the pawl component including four pawl arms that extend from the pawl component, wherein each pawl arm includes a fixed end that is attached to the pawl component and a free end that is positioned opposite the fixed end;

a plurality of teeth that are configured to engage with the free end of each pawl arm, the plurality of teeth and each pawl arm being configured so that as the pawl component and spool are rotated in the first direction, the free end of each pawl arm is deflected radially inward by the teeth and so that as the pawl component and spool are rotated in the second direction, the free end of each pawl arm engages with at least one tooth of the plurality of teeth to prevent the spool from rotating in the second direction;

wherein the pawl component includes a bottom surface that is positioned atop and directly engages the upper disc of the spool when the pawl component is attached to the spool.

2. The reel of claim 1, further comprising four drive members, wherein each drive member is positioned between the plurality of teeth and a portion of a respective pawl arm of the four pawl arms, wherein each drive member is movable relative to the plurality of teeth and the respective pawl arm and is configured to engage an outer edge of the respective pawl arm to displace the free end of the respective pawl arm radially inward to disengage the free end of the respective pawl arm and the at least one tooth and thereby allow the spool to rotate in the second direction.

3. The reel of claim 2, wherein the reel is configured so that disengagement of the free end of each pawl arm and the at least one tooth causes the spool to rotate in the second direction by an incremental amount and causes the free end of each pawl arm to reengage a different tooth.

4. The reel of claim 2, further comprising a knob that is operably coupled with the spool so that a rotation of the knob in the first direction causes the spool to rotate in the first direction and so that a rotation of the knob in the second direction causes each drive member to engage the outer edge of the respective pawl arm and disengage the free end of the respective pawl arm and the at least one tooth.

5. The reel of claim 4, wherein the four drive members are coupled with the knob, and wherein the four drive members and the pawl component are configured so that as the knob is rotated in the first direction, each drive member engages the pawl component and causes the pawl component and spool to rotate in the first direction.

6. The reel of claim 1, wherein the free end of each pawl arm engages with a single tooth.

7. The reel of claim 1, wherein the pawl component includes a centrally located aperture.

8. The reel of claim 1, wherein the plurality of teeth are coupled to the housing.

9. The reel of claim 1, wherein the spool includes one or more interface features that are configured to engage with corresponding interface features of the pawl component.

10. The reel of claim 9, wherein the one or more interface features of the spool extend axially upward from a top surface of the spool.

11. A reel for use in a lacing system, the reel comprising:

a housing having an interior region;

a knob that is rotatably coupled with the housing;

a spool rotatably positioned within the interior region of the housing, the spool being rotatable within the interior region in a first direction to wind a tension member about the spool and being rotatable in a second direction to unwind the tension member from about the spool;

a pawl component that is separate from the spool and from the knob, the pawl component being removably attachable to the spool so that the pawl component is rotatable with the spool in the first direction and in the second direction, the pawl component including at least one pawl arm that extends from the pawl component, the at least one pawl arm including a fixed end that is attached to the pawl component and a free end that is positioned opposite the fixed end;

a plurality of teeth that are configured to engage with the free end of the at least one pawl arm, the plurality of teeth and at least one pawl arm being configured so that as the pawl component and spool are rotated in the first direction, the free end of the at least one pawl arm is deflected radially inward by the teeth and so that as the pawl component and spool are rotated in the second direction, the free end of the at least one pawl arm engages with at least one tooth to prevent the spool from rotating in the second direction; and at least one drive member positioned between the plurality of teeth and a portion of the at least one pawl arm, wherein the at least one drive member is movable relative to the plurality of teeth and the at least one pawl arm and is configured to engage an outer edge of the at least one pawl arm to displace the free end of the at least one pawl arm radially inward to disengage the free end of the at least one pawl arm and the at least one tooth and thereby allow the spool to rotate in the second direction;

wherein a bottom portion of the pawl component is positioned atop and directly engages an upper portion of the spool.

12. The reel of claim 11, wherein the reel is configured so that disengagement of the free end of the at least one pawl arm and the at least one tooth causes the spool to rotate in the second direction by an incremental amount and causes the free end of the at least one pawl arm to reengage a different tooth.

13. The reel of claim 11, wherein the plurality of teeth are coupled to the housing.

14. The reel of claim 11, wherein the spool includes a plurality of axially extending interface features that are positioned toward a periphery the spool and that engage with corresponding interface features of the pawl component to removably attach the pawl component to the spool.

15. The reel of claim 11, wherein the pawl component includes four pawl arms, and wherein each pawl arm includes a fixed end that is attached to the pawl component and a free end that is positioned opposite the fixed end.

16. The reel of claim 11, wherein the pawl component includes a centrally located aperture.

17. The reel of claim 11, wherein the free end of the at least one pawl arm engages with a single tooth.

18. The reel of claim 11, wherein the knob is operably coupled with the spool so that a rotation of the knob in the first direction causes the spool to rotate in the first direction and a rotation of the knob in the second direction causes the at least one drive member to engage the outer edge of the at least one pawl arm and disengage the free end of the at least one pawl arm and the at least one tooth.

19. The reel of claim 18, wherein the at least one drive member is coupled with the knob, and wherein the at least one drive member and the pawl component are configured so that as the knob is rotated in the first direction, the at least one drive member engages the pawl component and causes the pawl component and spool to rotate in the first direction.

* * * * *